US010862212B2

(12) United States Patent
Yamagajo et al.

(10) Patent No.: US 10,862,212 B2
(45) Date of Patent: Dec. 8, 2020

(54) ANTENNA DEVICE AND WIRELESS COMMUNICATION DEVICE

(71) Applicant: FUJITSU LIMITED, Kawasaki (JP)

(72) Inventors: Takashi Yamagajo, Yokosuka (JP); Manabu Kai, Yokohama (JP); Yohei Koga, Kawasaki (JP); Tabito Tonooka, Kawasaki (JP); Hirotake Sumi, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 27 days.

(21) Appl. No.: 16/228,734

(22) Filed: Dec. 20, 2018

(65) Prior Publication Data

US 2019/0214726 A1 Jul. 11, 2019

(30) Foreign Application Priority Data

Jan. 5, 2018 (JP) ..... 2018-000721

(51) Int. Cl.

| | |
|---|---|
| ***H01Q 1/24*** | (2006.01) |
| ***H01Q 5/321*** | (2015.01) |
| ***H01Q 9/06*** | (2006.01) |
| ***H01Q 9/40*** | (2006.01) |
| ***H01Q 1/38*** | (2006.01) |

(Continued)

(52) U.S. Cl.

CPC ..... *H01Q 5/321* (2015.01); *H01Q 1/243* (2013.01); *H01Q 1/38* (2013.01); *H01Q 5/307* (2015.01); *H01Q 9/065* (2013.01); *H01Q 9/40* (2013.01); *H01Q 9/42* (2013.01); *H01Q 21/12* (2013.01)

(58) Field of Classification Search

CPC ..... H01Q 5/321; H01Q 5/307; H01Q 1/241–244; H01Q 1/38; H01Q 9/42; H01Q 9/065; H01Q 9/40; H01Q 21/12

See application file for complete search history.

(56) References Cited

U.S. PATENT DOCUMENTS

2004/0227683 A1* 11/2004 Caimi ..... H01Q 1/36 343/742
2005/0195124 A1* 9/2005 Puente Baliarda .. H01Q 9/0414 343/893

(Continued)

FOREIGN PATENT DOCUMENTS

JP 2001-144532 A 5/2001
JP 3212787 U 10/2017

(Continued)

*Primary Examiner* — Awat M Salih
(74) *Attorney, Agent, or Firm* — Arent Fox LLP

(57) ABSTRACT

An antenna device includes a ground plane having an edge side, a monopole antenna element that communicates in a first frequency, and that has a first feeding point, a first line that extends from the first feeding point in a direction away from the edge side of the ground plane, and a second line that is coupled to the first line and extends along the edge side, a plurality of dipole feeding elements that communicate at a second frequency higher than the first frequency, and are disposed, with respect to the ground plane, in positions that match the positions of the second line with respect to the ground plane, and a plurality of reflectors that reflect electromagnetic waves radiated by the plurality of feeding elements, and are disposed respectively in correspondence to the plurality of feeding elements between the ground plane and the plurality of feeding elements.

11 Claims, 26 Drawing Sheets

(51) Int. Cl.

| | |
|---|---|
| ***H01Q 21/12*** | (2006.01) |
| ***H01Q 9/42*** | (2006.01) |
| ***H01Q 5/307*** | (2015.01) |

(56) References Cited

U.S. PATENT DOCUMENTS

| | | | | |
|---|---|---|---|---|
| 2005/0237260 | A1* | 10/2005 | Bancroft | H01P 5/10 343/859 |
| 2011/0063181 | A1* | 3/2011 | Walker | H01Q 9/16 343/803 |
| 2015/0042531 | A1* | 2/2015 | Kitano | H01Q 9/285 343/793 |
| 2015/0311589 | A1 | 10/2015 | Yokoyama et al. | |
| 2016/0322702 | A1 | 11/2016 | Sayama et al. | |
| 2017/0194692 | A1* | 7/2017 | Sayama | H01Q 1/48 |
| 2017/0309992 | A1 | 10/2017 | Noori et al. | |
| 2020/0059009 | A1* | 2/2020 | Sonoda | H01Q 19/10 |

FOREIGN PATENT DOCUMENTS

| | | | |
|---|---|---|---|
| WO | WO 2014/097846 | A1 | 6/2014 |
| WO | WO 2015/108133 | A1 | 7/2015 |

* cited by examiner

ANTENNA DEVICE AND WIRELESS COMMUNICATION DEVICE

CROSS-REFERENCE TO RELATED APPLICATION

This application is based upon and claims the benefit of priority of the prior Japanese Patent Application No. 2018-721, filed on Jan. 5, 2018, the entire contents of which are incorporated herein by reference.

FIELD

The embodiments discussed herein relate to an antenna device and a wireless communication device.

BACKGROUND

Conventionally, a multiband antenna that is provided with at least two radiating elements, a high frequency power feeding unit that feeds a high frequency signal to each of the radiating elements, and a radiating element connection line that connects the radiating elements in series and forms a series radiating element. The multiband antenna is further provided with a low frequency power feeding unit that is connected to one end side of the series radiating element through a low frequency power feeding line and feeds a low frequency signal, and a high frequency interruption circuit that is connected to the radiating element connection line and the low frequency power feeding line and interrupts transmission of the high frequency signal. The multiband antenna radiates the high frequency signal from the radiating elements and radiates the low frequency signal from the series radiating element.

However, in the conventional multiband antenna (antenna device), the radiating element (antenna element) for low frequency and the radiating element (antenna element) for high frequency are connected by the radiating element connection line. As a result, it is difficult to separately adjust the radiation characteristics of the antenna element for low frequency and the radiation characteristics of the antenna element for high frequency.

The following is a reference document.

[Document 1] International Publication Pamphlet No. WO 2014-097846

SUMMARY

According to an aspect of the embodiments, an antenna device includes a ground plane having an edge side, a monopole antenna element that communicates in a first frequency, and that has a first feeding point, a first line that extends from the first feeding point in a direction away from the edge side of the ground plane, and a second line that is coupled to the first line and extends along the edge side, a plurality of dipole feeding elements that communicate at a second frequency higher than the first frequency, and are disposed, with respect to the ground plane, in positions that match the positions of the second line with respect to the ground plane, and a plurality of reflectors that reflect electromagnetic waves radiated by the plurality of feeding elements, and are disposed respectively in correspondence to the plurality of feeding elements between the ground plane and the plurality of feeding elements.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

The following discusses embodiments applicable to an antenna device and a wireless communication device according to the present disclosure.

First Embodiment

Figure 1:
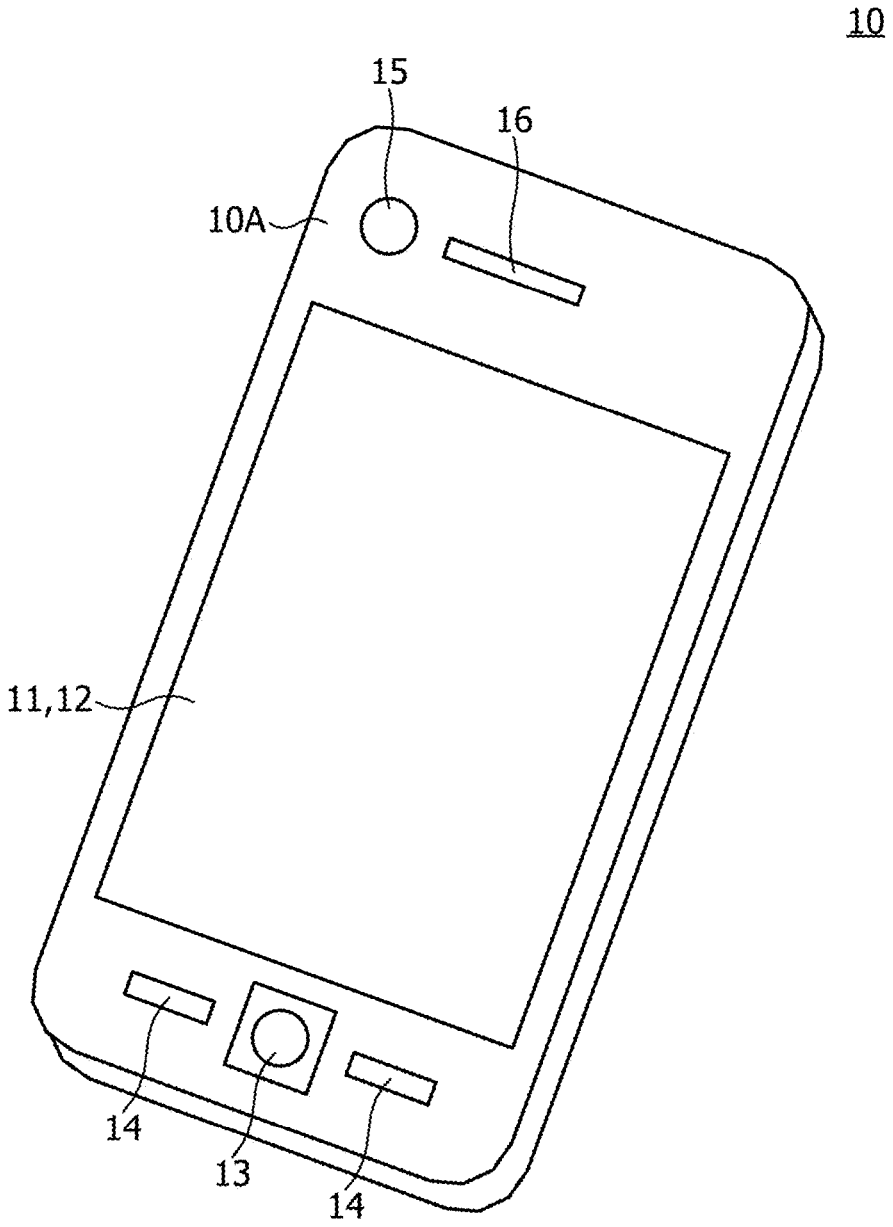
FIG. 1 is a perspective view illustrating a front surface side of a smartphone terminal device which includes an antenna device according to a first embodiment.

FIG. 1 is a perspective view illustrating a front surface side of a smartphone terminal device 10 which includes an antenna device according to a first embodiment. The smartphone terminal device 10 is an example of a wireless communication device that includes the antenna device of the first embodiment.

A touch panel 11 and a display panel 12 are arranged on the front surface side of a casing 10A of the smartphone terminal device 10, and a home button 13 and switches 14 are arranged on the lower side of the touch panel 11. A camera 15 and a speaker 16 are also arranged on the upper side of the touch panel 11. The touch panel 11 is disposed on the outer surface side of the display panel 12.

The wireless communication device that includes the antenna device according to the first embodiment is not limited to the smartphone terminal device 10 and may be a tablet computer, a mobile telephone terminal, a game terminal, or the like.

Figure 2:
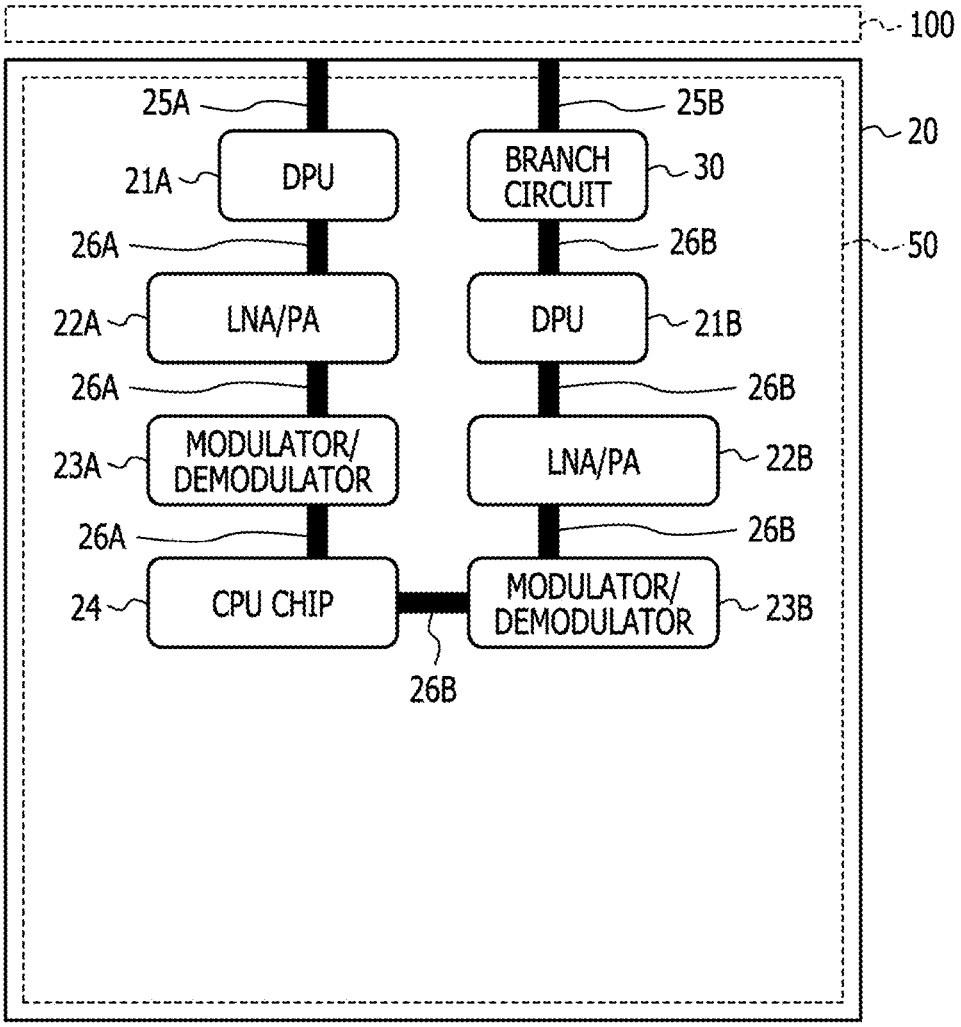
FIG. 2 is a view illustrating a wiring substrate of the smartphone terminal device and configuration elements mounted on the wiring substrate.

FIG. 2 is a view illustrating a wiring substrate 20 of the smartphone terminal device 10 and configuration elements mounted on the wiring substrate 20. The wiring substrate 20 is arranged inside the case 10A (see FIG. 1).

Duplexers (DUP) 21A, 21B, low noise amplifiers/power amplifiers (LNA/PA) 22A, 22B, modulators/demodulators 23A, 23B, a central processing unit (CPU) chip 24, and a branch circuit 30 are mounted on the surface of the wiring substrate 20 illustrated in FIG. 2.

The DUPs 21A, 21B, the LNA/PAs 22A, 22B, the modulators/demodulators 23A, 23B, the CPU chip 24, and the branch circuit 30 are examples of feeder circuits.

The wiring substrate 20 has a ground plane 50. The ground plane 50 is an internal layer of the wiring substrate 20 or is arranged on the surface opposite the surface on which the DUPs 21A, 21B, the LNA/PAs 22A, 22B, the modulators/demodulators 23A, 23B, the CPU chip 24, and the branch circuit 30 are mounted. Here a mode is discussed in which the ground plane 50 is disposed on the rear surface side in FIG. 2 as an example. The ground plane 50 has an edge side 50A.

In addition, an antenna device 100 of the first embodiment is arranged in the proximity of the edge side 50A of the ground plane 50 of the wiring substrate 20. The position of the antenna device 100 is represented by the dashed line in FIG. 2 because a detailed configuration of the antenna device 100 is discussed below.

The wiring substrate 20 may be disposed inside the casing 10A of the smartphone terminal device 10 illustrated in FIG. 1 so that the antenna device 100 is positioned toward the side where the home button 13 and the switch 14 are positioned (on the bottom side of the touch panel 11). Additionally, the wiring substrate 20 may be disposed so that the antenna device 100 is positioned toward the side where the camera 15 and the speaker 16 are positioned (on the upper side of the touch panel 11).

The wiring substrate 20 may also be disposed so that the ground plane 50 is positioned on the touch panel 11 side, or the wiring substrate 20 may be disposed so that the ground plane 50 is positioned on the side opposite the touch panel 11.

The antenna device 100 includes a monopole antenna element that communicates (resonates) at a communication frequency f1, and an antenna array that communicates (resonates) at a communication frequency f2 that is higher than the communication frequency f1. The DUP 21A is connected to the antenna element and the DUP 21B is connected to the antenna array via the branch circuit 30.

The DUP 21A, the LNA/PA 22A, the modulator/demodulator 23A, and the CPU chip 24 are connected through a wire 26A.

The DUP 21A is connected to the antenna element of the antenna device 100 by means of a wire 25A and a via, which is not illustrated, that penetrates the wiring substrate 20, and the DUP 21A switches between transmitting and receiving. The DUP 21A has a filtering function, and when the antenna device 100 receives signals in a plurality of frequencies, the DUP 21A is able to divide the signals of each of the frequencies.

The LNA/PA 22A amplifies the power of transmitting waves and receiving waves. The modulator/demodulator 23A modulates the transmitting waves and demodulates the receiving waves. The CPU chip 24 has a function as a communication processor for processing communication of the smartphone terminal device 10 and a function as an application processor for executing application programs. The CPU chip 24 has an internal memory for storing data to be transmitted or data that has been received and the like.

The branch circuit 30, the DUP 21B, the LNA/PA 22B, the modulator/demodulator 23B, and the CPU chip 24 are connected through a wire 26B. The handling frequencies of the DUP 21B, the LNA/PA 22B, and the modulator/demodulator 23B are different than those of the respective DUP 21A, the LNA/PA 22A, and the modulator/demodulator 23A, but the configurations are the same.

The branch circuit 30 is connected to the antenna array of the antenna device 100 by means of the wire 25B and a via, which is not illustrated, that penetrates the wiring substrate 20. When the antenna device 100 transmits signals from the antenna array, the branch circuit 30 branches and transmits the signals input by the DUP 21B to the plurality of feeding elements included in the antenna array. In addition, when the antenna device 100 receives signals with the antenna array, the branch circuit 30 transmits the signals input from the plurality of feeding elements included in the antenna array, to the DUP 21B.

Because there is a plurality of antenna arrays of the antenna device 100, the same number of the wires 25B and the vias in the wiring substrate 20 as the number of the antenna arrays of the antenna device 100 are present.

The wires 25A, 25B, 26A, and 26B are formed, for example, by patterning copper foil on the surface of the wiring substrate 20. The wires 25A and 25B which are connected directly to the antenna device 100 may be micro strip lines. In addition, while omitted in FIG. 2, matching circuits for adjusting the impedance characteristics are disposed between the antenna element and the antenna array of the antenna device 100 and the DUPs 21A and 21B.

Figure 3:
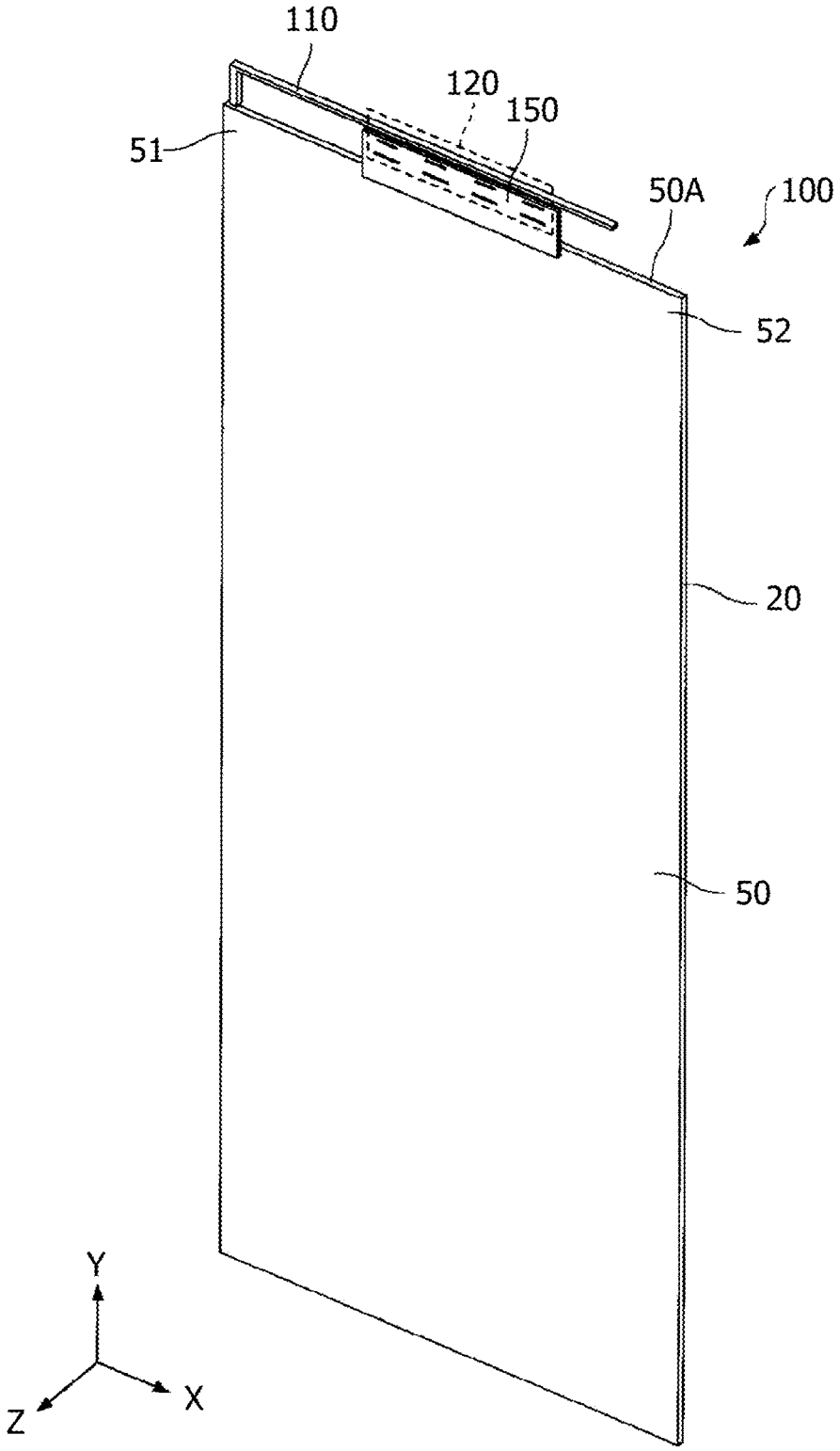
FIG. 3 is a perspective view of an antenna device according to the first embodiment.
Figure 4A:
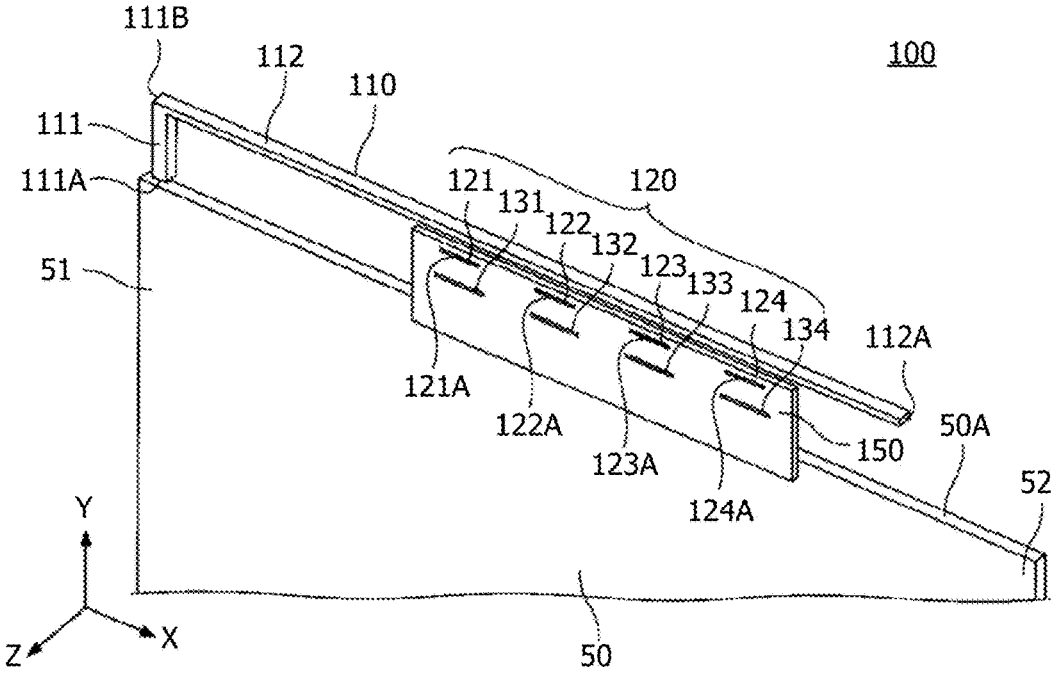
FIGS. 4A to 4C are views of an enlargement of a portion of FIG. 3.
Figure 4B:
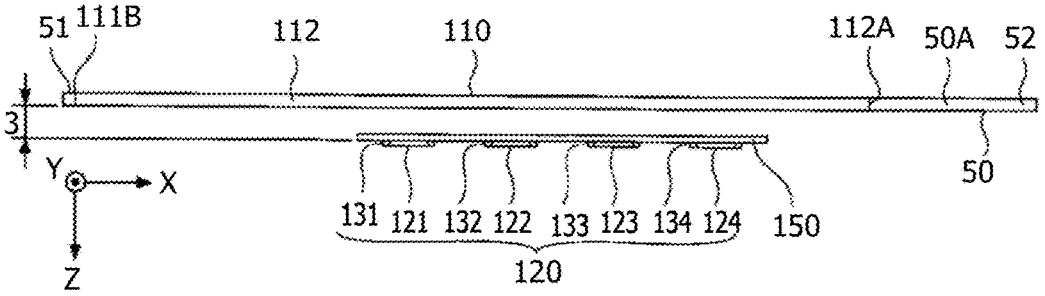
Figure 4C:
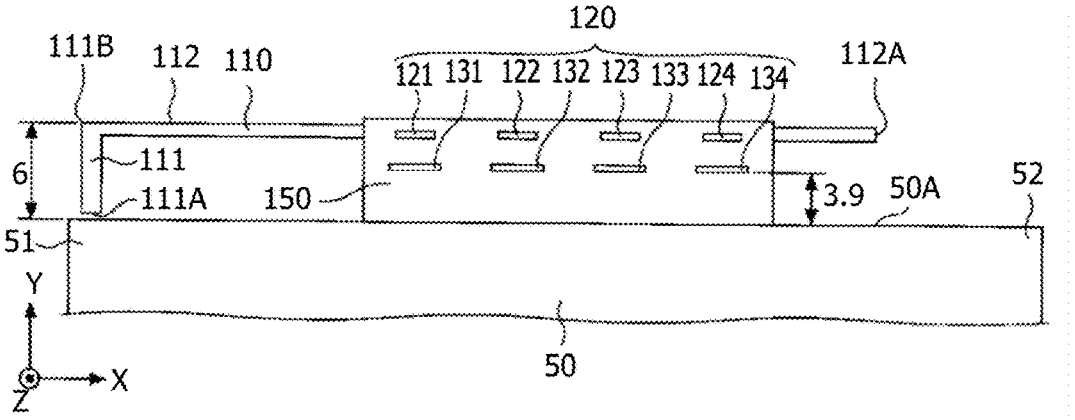

FIG. 3 is a perspective view of the antenna device 100 according to the first embodiment. FIGS. 4A to 4C are views of an enlargement of a portion of FIG. 3. FIG. 4A is a perspective view, FIG. 4B is a view illustrating a configuration on the XZ-plane, and FIG. 4C is a view illustrating a configuration on the XY-plane. The following explanation makes use of common XYZ coordinates and the plan view is the view of the XY-plane.

The antenna device 100 includes the ground plane 50, an antenna element 110, and an antenna array 120, and a support substrate 150. While the antenna device 100 may further include the wiring substrate 20 (see FIG. 2) in addition to the aforementioned configuration elements, illustration of the wiring substrate 20 is omitted in FIG. 3 and FIGS. 4A to 4C.

The ground plane 50 has a rectangular shape when seen in a plan view and has the edge side 50A that extends in the X-axis direction on the Y-axis positive direction side. In addition, the ground plane 50 has an apex 51 on one side of the edge side 50A and an apex 52 on the other side of the edge side 50A.

While a linear edge side 50A is illustrated in FIGS. 3 and 4, the edge side 50A may be, for example, non-linear due to the disposition of recesses and projections that match the internal shape and the like of the casing 10A of the smartphone terminal device 10 (wireless communication device) that includes the antenna device 100.

Moreover, while three edges of the ground plane 50 other than the edge side 50A among the four edges of the ground plane 50 are illustrated as linear in FIG. 3, the other three edges may also be non-linear in the same way as the edge side 50A. Moreover, while FIG. 3 illustrates the ground plane 50 having a solid pattern, the ground plane 50 may not have a solid pattern and openings and the like may be formed in the ground plane 50.

The antenna element 110 is an L-shaped monopole antenna element having a line 111, a feeding point 111A, a bent part 111B, a line 112, and an open end 112A. The antenna element 110 is an example of a first antenna element. The line 111 is an example of a first line, the feeding point 111A is an example of a first feeding point, and the line 112 is an example of a second line.

The line 111 extends in the Y-axis direction from the feeding point 111A that is positioned in the proximity of the apex 51, and is connected at the bent part 111B to the line 112 that extends in the X-axis direction. The antenna element 110 is, for example, an antenna element that communicates in an ultra-high frequency (UHF) band. The communication frequency f1 of the antenna element 110 is 860 MHz as an example. The communication frequency f1 is an example of a first frequency. While a mode in which the communication frequency f1 is 860 MHz is discussed herein, the communication frequency f1 may be higher or may be lower.

The length (total length) of the antenna element 110 from the feeding point 111A through the bent part 111B to the open end 112A is set to a quarter wavelength ($\lambda_1/4$) of the electrical length $\lambda_1$ of the wavelength at 860 MHz. In addition, the width of the antenna element 110 in the Z-axis direction is 0.2 mm as an example.

The distance in the Y-axis direction between the line 112 and the edge side 50A of the ground plane 50 may be set to 1/40 or less of the electrical length λ1 of the wavelength at 860 MHz. As an example, the distance between the line 112 and the edge side 50A of the ground plane 50 is set to 6 mm.

While the bent part has been explained as the bent part 111B herein, the mode is not limited to one in which the line 111 and the line 112 are realized by bending a metal layer, and a separate line 111 may be connected to a separate line 112 with the bent part 111B. The bent part 111B may be treated as a connection part.

The antenna array 120 has four feeding elements 121, 122, 123, and 124 (hereinbelow 121-124) and four reflectors 131, 132, 133, and 134 (hereinbelow 131-134).

The feeding elements 121-124 are disposed on the surface on the Z-axis positive direction side of the support substrate 150 which is disposed further to the Z-axis positive direction side than the antenna element 110 and the ground plane 50. The feeding elements 121-124 are array-type feeding elements for the fifth generation (5G) specification as an example.

The feeding elements 121-124 are arrayed in a single line along the X axis and are arrayed in order from the X-axis negative direction side toward the X-axis positive direction side. The distance in the Y-axis direction between the feeding elements 121-124 and the edge side 50A of the ground plane 50 is the same as the distance in the Y-axis direction between the line 112 of the antenna element 110 and the edge side 50A of the ground plane 50.

That is, the feeding elements 121-124 are disposed at positions in the Y-axis direction that are equal to the line 112 of the antenna element 110 relative to the edge side 50A of the ground plane 50.

The lengths in the X-axis direction of the feeding elements 121-124 are equal to each other and are set, as an example, to a half wavelength ($\lambda_2/2$) of an electrical length $\lambda_2$ of the wavelength at the communication frequency f2 in the millimeter wave (submillimeter wave) band. The communication frequency f2 is, as an example, 28 GHz and a submillimeter wave or a millimeter wave. While a mode in which the communication frequency f2 is 28 GHz is discussed herein, the communication frequency f2 may be higher or may be lower. For example, the communication frequency f2 may be approximately 60 GHz.

The feeding elements 121-124 are each dipole antenna elements that have feeding points 121A, 122A, 123A, 124A (hereinbelow 121A-124A) in the center of the length in the X-axis direction. The feeding points 121A-124A are connected to the branch circuit 30 through a via that penetrates an insulator layer of the support substrate 150, through a wire disposed in an internal layer of the support substrate 150, through a via that penetrates the wiring substrate 20 (see FIG. 2), and through the wire 25B.

The interval in the Z-axis direction between the feeding elements 121-124 and the line 112 of the antenna element 110 is set to 3 mm as an example.

The reflectors 131-134 are disposed on the surface in the Z-axis positive direction side of the support substrate 150. The reflectors 131-134 are arrayed in a single line along the X axis and are arrayed in order from the X-axis negative direction side toward the X-axis positive direction side further toward the Y-axis negative direction side than the feeding elements 121-124.

The reflectors 131-134 are respectively disposed so as to reflect electromagnetic waves radiated by the feeding elements 121-124 in the Y-axis positive direction. The lengths in the X-axis direction of the reflectors 131-134 are slightly greater than the lengths in the X-axis direction of the feeding elements 121-124. The centers in the length in the X-axis direction of the reflectors 131-134 are disposed so as to match the feeding points 121A-124A in the X-axis direction.

In addition, the interval in the Y-axis direction between the reflectors 131-134 and the feeding elements 121-124 is set to be no more than a quarter wavelength ($\lambda_2/4$) of the electrical length $\lambda_2$ of the wavelength at the communication frequency f2.

In addition, the interval in the Y-axis direction between the reflectors 131-134 and the edge side 50A of the ground plane 50 may be set to be no less than a quarter wavelength ($\lambda_2/4$) of the electrical length $\lambda_2$ of the wavelength at the communication frequency f2. The above interval is set to 3.9 mm as an example. Moreover, the interval in the Z-axis direction between the ground plane 50 and the feeding elements 121-124 and the reflectors 131-134 is set to 3 mm as an example.

By using the aforementioned reflectors 131-134, the electromagnetic waves radiated in the Y-axis negative direction by the feeding elements 121-124 may be reflected in the Y-axis positive direction whereby the directionality of the feeding elements 121-124 is set to the Y-axis positive direction and gain may be increased.

The support substrate 150 is a substrate for supporting the antenna array 120 (the feeding elements 121-124 and the reflectors 131-134). The support substrate 150 may be a FR4 standard wire substrate or a thin resin substrate. A mode in which the support substrate 150 is a multilayer board having internal layers is explained herein.

In addition, a mode in which the antenna array 120 is formed on the surface in the Z-axis positive direction side of the support substrate 150 is explained herein as an example. Wires for connecting the feeding elements 121-124 to the wire 25B (see FIG. 2) are disposed in the internal layers of the support substrate 150.

The aforementioned support substrate 150 may be attached to the wiring substrate 20 (see FIG. 2), to an inner wall of the casing 10A (see FIG. 1), or the like.

Figure 5:
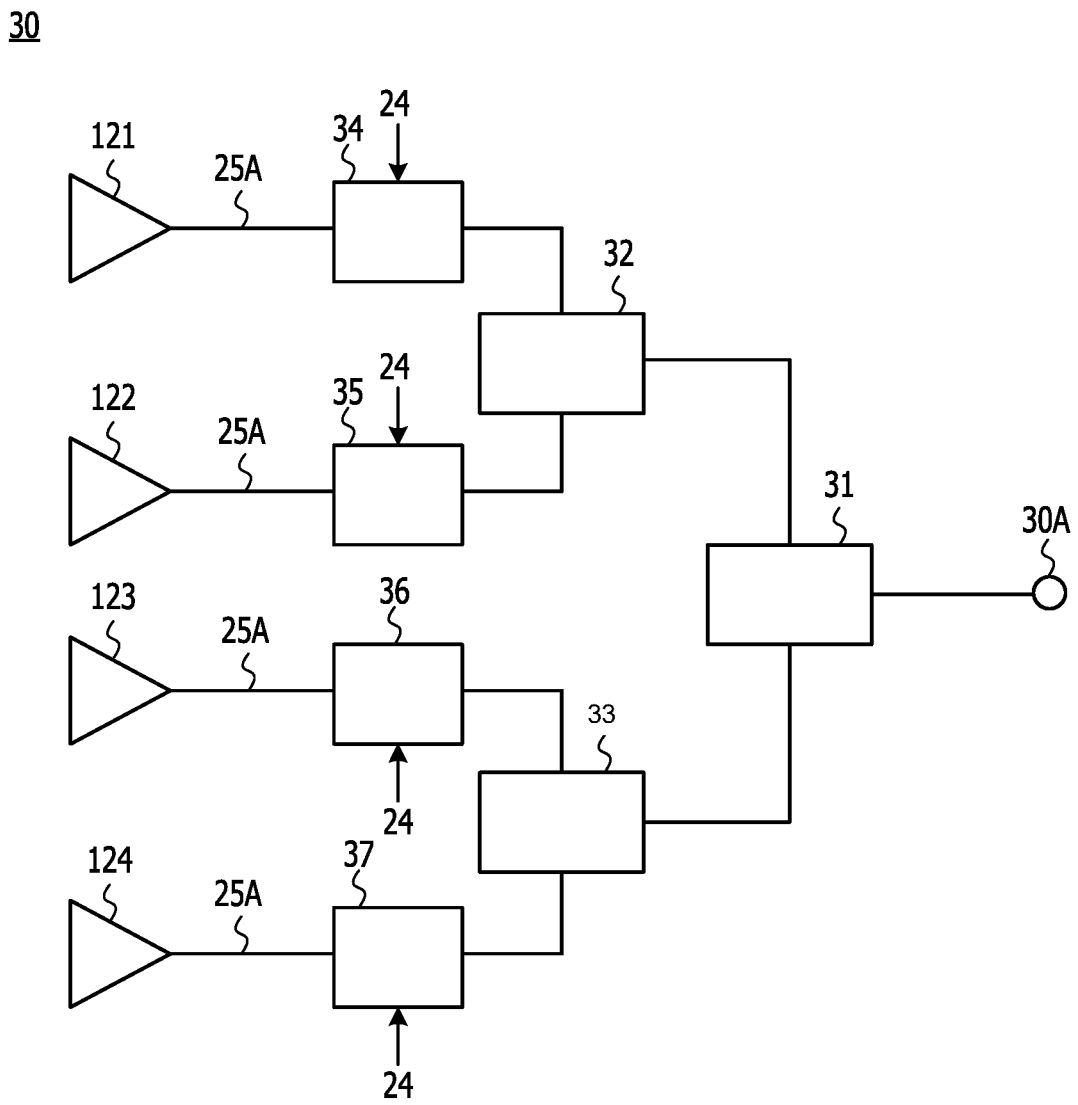
FIG. 5 is a view of a configuration of a branch circuit.

FIG. 5 is a view of a configuration of the branch circuit 30.

The branch circuit 30 has an input/output terminal 30A, branch parts 31, 32, 33, and phase shifters 34, 35, 36, 37 (hereinbelow 34-37). The input/output terminal 30A is connected to the DUP 21B through the wire 26B.

The branch parts 31, 32, 33 split transmission signals into two signals and output the transmission signals, and combine reception signals into one signal and output the one reception signal. The branch part 31 is connected between the input/output terminal 30A and branch parts 32 and 33. The branch part 32 is connected between the branch part 31 and the phase shifters 34 and 35. The branch part 33 is connected between the branch part 31 and the phase shifters 36 and 37.

The phase shifters 34-37 are connected to the feeding elements 121-124 through the four wires 25A. The phase shifters 34-37 shift the phases of the signals input from the branch parts 32 and 33 based on signals that represent phases input by the CPU chip 24, and output the phase-shifted signals. As a result, the radiation angle of one beam generated by the millimeter waves output by the feeding elements 121-124 may be adjusted within the XY-plane. In addition, when signals are received from the feeding elements 121-124, the phase shifters 34-37 shift the phases of the signals input from the feeding elements 121-124 based on signals that represent phases input by the CPU chip 24, and output the phase-shifted signals to the branch parts 32 and 33.

When the feeding elements 121-124 transmit a signals, the branch part 31 splits the signal received from the input/output terminal 30A into two signals and outputs the two signals to the branch parts 32 and 33. The branch part 32 splits the signal received from the branch part 31 into two signals and outputs the two signals to the phase shifters 34 and 35. The branch part 33 splits the signal received from the branch part 31 into two signals and outputs the two signals to the phase shifters 36 and 37.

When the feeding elements 121-124 receive signals, the branch part 32 combines the signals input from the phase shifters 34 and 35 and outputs the combined signal to the branch part 31. The branch part 33 combines the signals input from the phase shifters 36 and 37 and outputs the combined signal to the branch part 31. The branch part 31 combines the signals input from the branch parts 32 and 33 and outputs the combined signal to the DUP 21B.

Figure 6A:
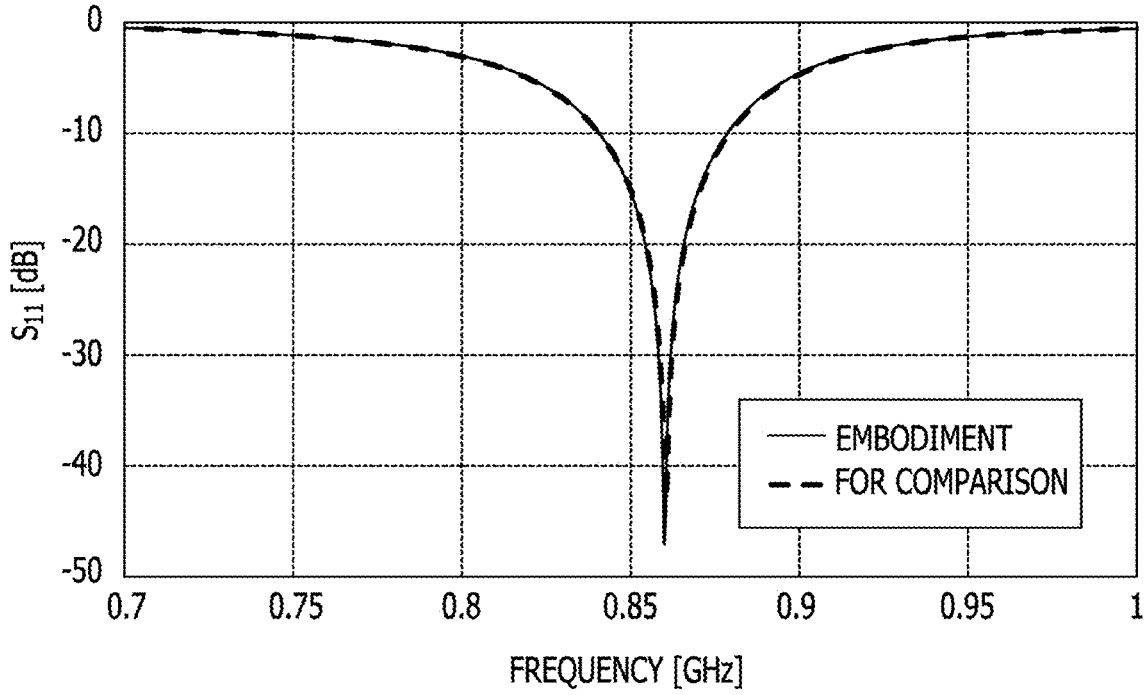
FIGS. 6A and 6B are views for illustrating simulation results of $S_{11}$ parameters and total efficiency of an antenna element.
Figure 6B:
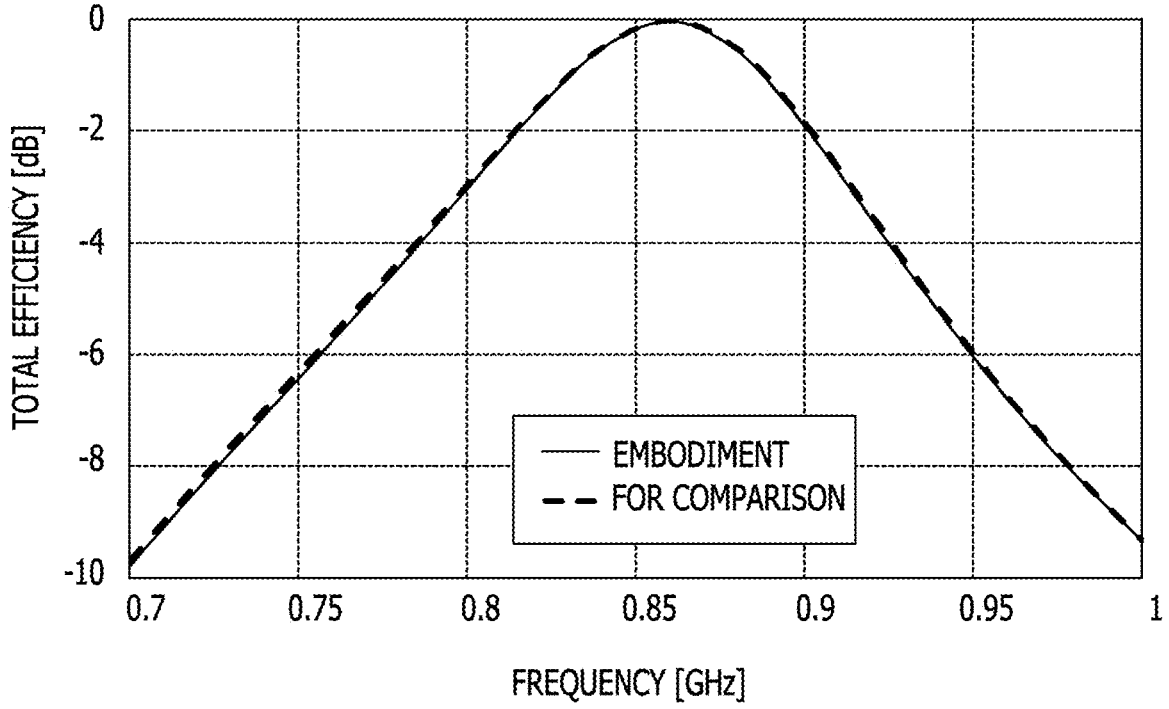

FIGS. 6A to 6B are views for illustrating simulation results of $S_{11}$ parameters and total efficiency of the antenna element 110. Simulation results are illustrated herein for comparison of the $S_{11}$ parameters and the total efficiency of the antenna element 110 in an antenna device configured with the antenna array 120 and the support substrate 150 removed from the antenna device 100.

Hereinbelow, the antenna element 110 of the antenna device 100 is referred to as the antenna element 110 of the first embodiment and is differentiated from the antenna element 110 for comparison. The $S_{11}$ parameters and the total efficiency of the antenna element 110 of the first embodiment are represented by solid lines and the $S_{11}$ parameters and the total efficiency of the antenna element 110 for comparison are represented by dashed lines.

As illustrated in FIG. 6A, the $S_{11}$ parameters of the antenna element 110 of the first embodiment are approximately −47 dB at 860 MHz and substantially the same results are obtained with the $S_{11}$ parameters of the antenna element 110 for comparison.

Moreover as illustrated in FIG. 6B, the total efficiency of the antenna element 110 of the first embodiment is approximately 0 dB at 860 MHz and substantially the same results are obtained with the total efficiency of the antenna element 110 for comparison.

According to the above results, it may be seen that there is almost no effect on the radiation characteristics of the antenna element 110 due to the addition of the antenna array 120.

Figure 7:
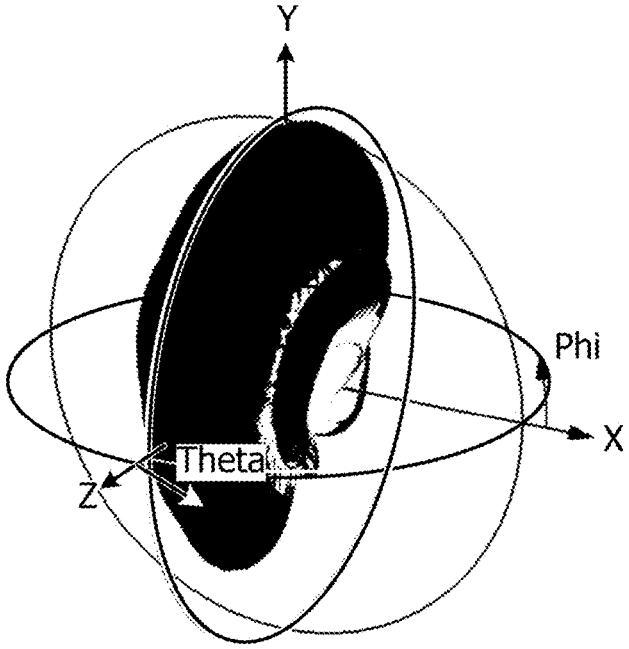
FIG. 7 is a view for illustrating simulation results of a radiation pattern of an antenna array according to the first embodiment.

FIG. 7 is a view for illustrating simulation results of a radiation pattern (absolute gain characteristics) of the antenna array 120 according to the first embodiment. As illustrated in FIG. 7, directionality in the Y-axis positive direction is depicted and it may be seen that a beam having a high intensity is radiated in the Y-axis positive direction.

FIG. 7 is a view for illustrating simulation results of a radiation pattern (absolute gain characteristics) on the XY-plane of the antenna array 120 according to the first embodiment. The radiation characteristics are characteristics obtained when Theta (θ) in FIG. 7 is fixed and Phi (φ) is oscillated. In addition, the radiation characteristics of the antenna array 120 of the first embodiment are represented by solid lines and the radiation characteristics of the antenna array 120 for comparison are represented by dashed lines in FIG. 8. The antenna array 120 for comparison is the antenna array 120 of the antenna device configured by removing the antenna element 110 from the antenna device 100.

Figure 8:
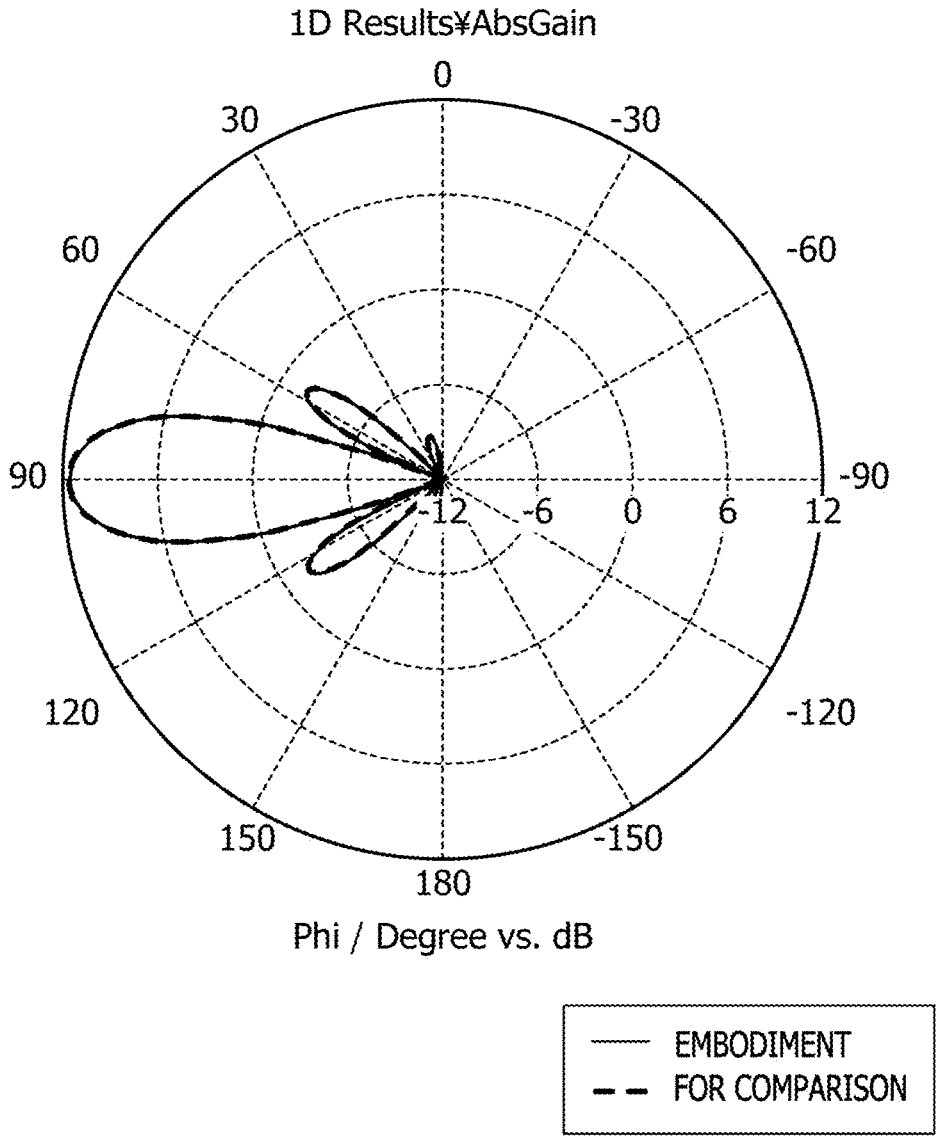
FIG. 8 is a view for illustrating simulation results of a radiation pattern on the XY-plane of the antenna array according to the first embodiment.

As illustrated in FIG. 8, the directionality of radiation characteristics of the antenna array 120 of the first embodiment is depicted in the Y-axis positive direction (90-degree direction) and it may be seen that a beam having a high intensity is radiated in the Y-axis positive direction. The above characteristics are substantially the same as the radiation characteristics of the antenna array 120 for comparison depicted with the dashed lines.

Figure 9:
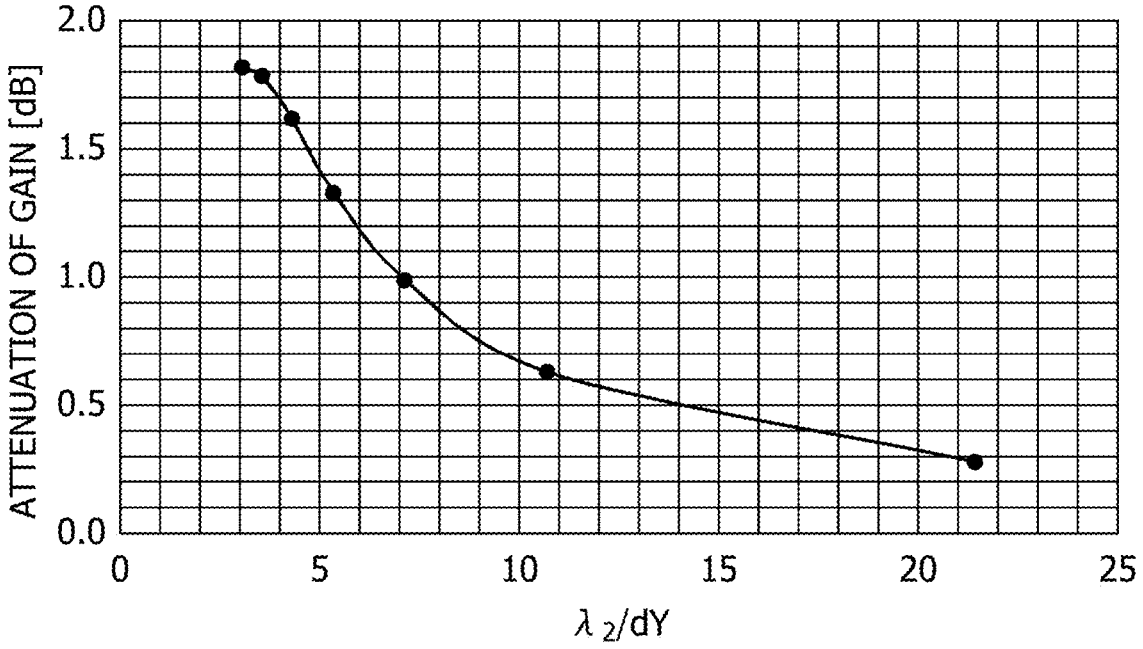
FIG. 9 is a view illustrating the relationship between positions in the Y-axis direction of feeding elements of the antenna array with respect to the line of the antenna element, and attenuation of the gain of the antenna array.

FIG. 9 is a view for illustrating the relationship between positions in the Y-axis direction of the feeding elements 121-124 of the antenna array 120 with respect to the line 112 of the antenna element 110, and attenuation of the gain of the antenna array 120. The characteristics depicted in FIG. 9 are obtained by a magnetic field simulation.

Because the following discussion describes cases when the positions of the line 112 and the feeding elements 121-124 in the Y-axis direction match each other and when the same positions are offset from one another, the interval in the Y-axis direction between the line 112 and the feeding elements 121-124 is established as dY. In FIG. 9, the interval dY is 0 mm. The interval dY takes a positive value when the feeding elements 121-124 are below the line 112 in the Y-axis direction. Moreover, the positions in the Y-axis direction of the feeding elements 121-124 with respect to the line 112 and depicted on the horizontal axis in FIG. 9 represent values ($\lambda_2$/dY) obtained by dividing the electrical length $\lambda_2$ of the wavelength at 28 GHz by the interval dY.

That is, as the value ($\lambda_2$/dY) on the horizontal axis increases, the interval dY becomes correspondingly shorter which indicates that the feeding elements 121-124 are closer to the line 112. As the value ($\lambda_2$/dY) on the horizontal axis decreases, the interval dY becomes correspondingly greater which indicates that the feeding elements 121-124 are further away from the line 112.

The attenuation of the gain is a value calculated by using the value when the positions (heights) in the Y-axis direction of the line 112 and the feeding elements 121-124 are all zero (when dY=0).

As illustrated in FIG. 9, the attenuation of the gain increases as the value ($\lambda_2$/dY) on the horizontal axis becomes smaller. The attenuation of the gain is approximately 1.0 when the value ($\lambda_2$/dY) on the horizontal axis is approximately 7, and the attenuation of the gain is approximately 1.6 when the value ($\lambda_2$/dY) on the horizontal axis is approximately 4. The interval dY is approximately $\lambda_2/7$ when the value ($\lambda_2$/dY) on the horizontal axis is approximately 7, and the interval dY is approximately $\lambda_2/4$ when the value ($\lambda_2$/dY) on the horizontal axis is approximately 4.

In this way, it may be seen that the gain of the antenna array 120 decreases when the positions (heights) in the Y-axis direction of the line 112 and the feeding elements 121-124 are shifted. Therefore, it is desirable that the positions (heights) in the Y-axis direction of the line 112 and the feeding elements 121-124 are equal to each other.

While the positions (heights) in the Y-axis direction of the line 112 and the feeding elements 121-124 may be shifted within a range that does not affect the gain of the antenna array 120, shifting in the positions (heights) in the Y-axis direction is preferably as small as possible. That is, it is desirable that the positions (heights) in the Y-axis direction of the line 112 and the feeding elements 121-124 match each other. The heights matching each other signifies that the heights are equal or that the differences in height are within a range that does not affect the gain of the antenna array 120.

In the antenna device 100 described above, the angle of the beam output by the antenna array 120 may be adjusted within the XY-plane due to the phase shifters 34-37 adjusting the phases applied to the input signals.

Therefore according to the first embodiment, a configuration may be realized in which almost no adverse effects are felt between the antenna element 110 that communicates in the UHF band and the antenna array 120 that communicates in the submillimeter wave (millimeter wave) band due to the disposition of the feeding elements 121-124 of the antenna array 120 that communicates in the submillimeter wave (millimeter wave) band, adjacent to the line 112 of the antenna element 110. The heights on the Y-axis direction of the line 112 and the feeding elements 121-124 match each other with respect to the edge side 50A of the ground plane 50.

Furthermore, because the antenna element 110 and the antenna array 120 are radiation elements that are separate without being connected to each other, the radiation characteristics of the antenna element 110 and the radiation characteristics of the antenna array 120 may be adjusted separately. The radiation characteristics discussed herein include the radiation pattern and/or the impedance.

Therefore, an antenna device 100 and a smartphone terminal device 10 (wireless communication device) may be provided in which the radiation characteristics of an antenna element for low frequencies and the radiation characteristics of an antenna element for high frequencies may be adjusted separately.

In particular, because the beam direction of the antenna array 120 for 5G wavers, the ability to adjust the radiation characteristics separately from the antenna element 110 is desirable.

While the above discussion describes a mode in which the antenna element 110 has an L-shape, the radiation element may have an F-shape or another shape.

While the above discussion describes a mode in which the feeding elements 121-124 and the reflectors 131-134 are disposed on the surface on the Z-axis positive direction side of the support substrate 150, the feeding elements 121-124 and the reflectors 131-134 may be disposed on the Z-axis negative direction side of the support substrate 150.

Moreover, the feeding elements 121-124 and the reflectors 131-134 may not be disposed on the same surface as the support substrate 150 and may be disposed on different surfaces.

Second Embodiment

Figure 10:
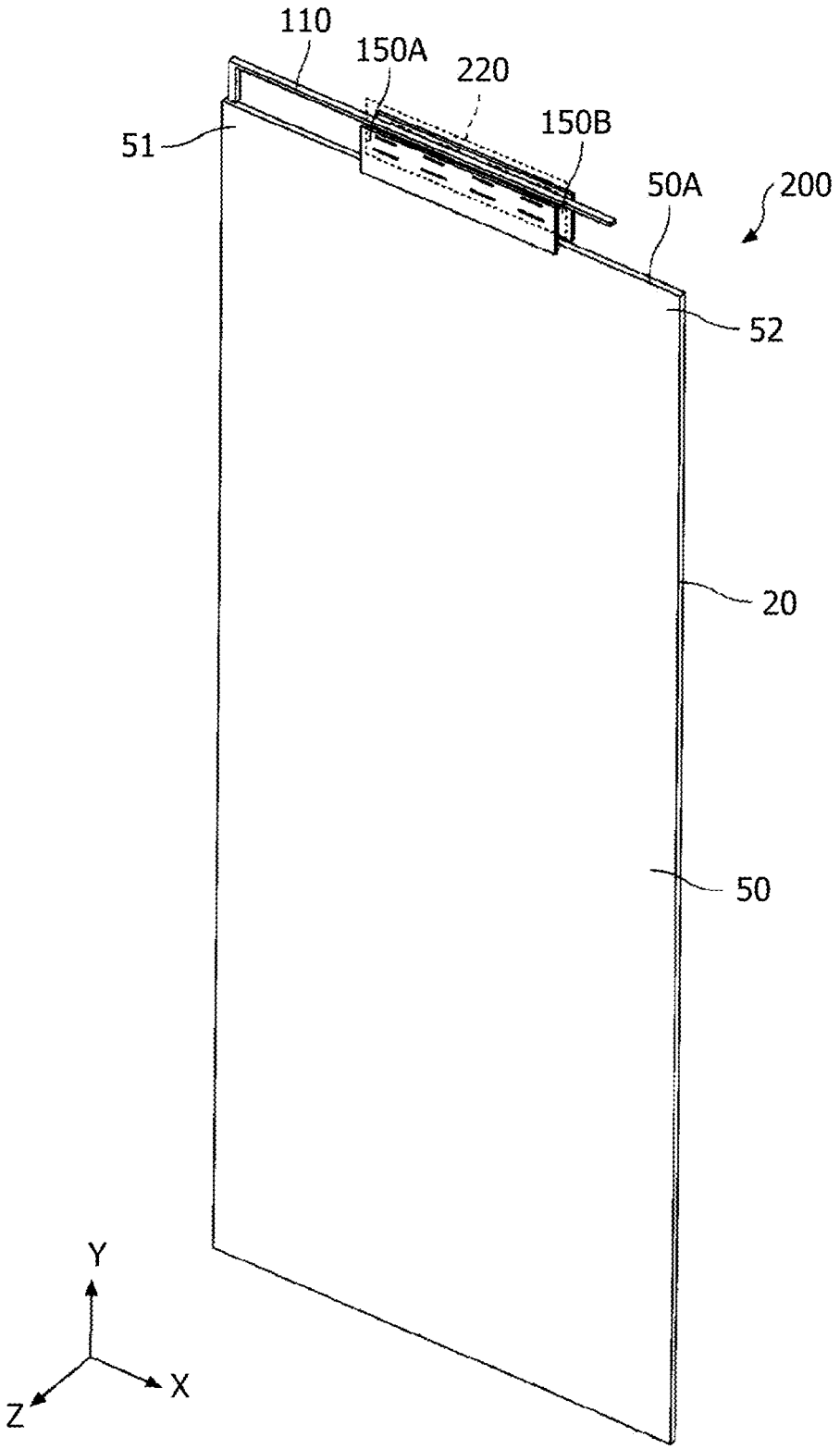
FIG. 10 is a perspective view of an antenna device according to a second embodiment.
Figure 11A:
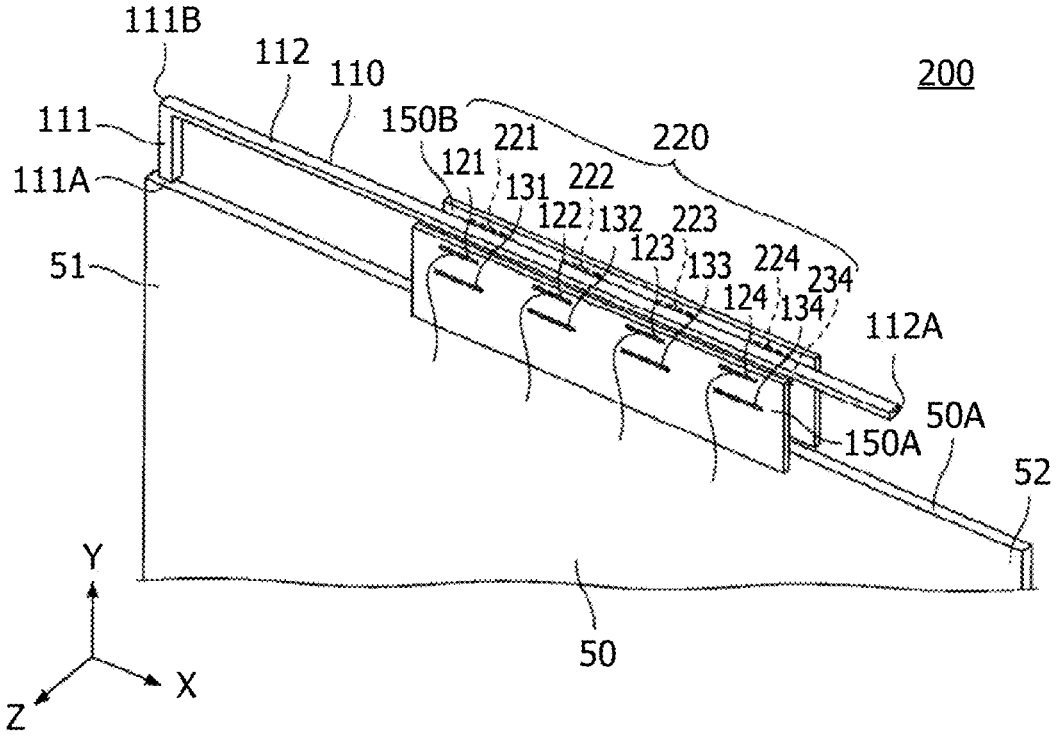
FIGS. 11A and 11B are views of an enlargement of a portion of FIG. 10.
Figure 11B:
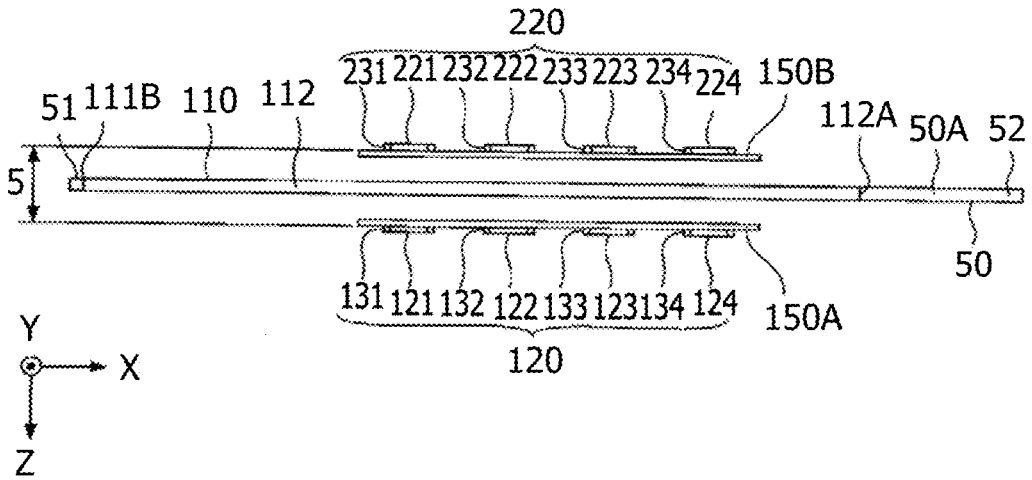

FIG. 10 is a perspective view of an antenna device 200 according to a second embodiment. FIGS. 11A and 11B are views of an enlargement of a portion of FIG. 10. FIG. 11A is a perspective view and FIG. 11B is a view illustrating a configuration on the XZ-plane. The same XYZ coordinates as the first embodiment are used in the second embodiment in the following explanation. Configuration elements that are the same as the configuration items of the first embodiment are given the same reference numeral and explanations thereof will be omitted.

The antenna device 200 includes the ground plane 50, the antenna element 110, an antenna array 220, and support substrates 150A and 150B. While the antenna device 200 may further include the wiring substrate 20 (see FIG. 2) in addition to the aforementioned configuration elements, illustration of the wiring substrate 20 is omitted in FIGS. 10, 11A and 11B.

The antenna device 200 is one in which the antenna array 120 of the antenna device 100 of the first embodiment is replaced by the antenna array 220. Accordingly, the antenna device 200 includes the two support substrates 150A and 150B which are the same as the support substrate 150 of the first embodiment.

The antenna array 220 has the four feeding elements 121-124 and the four reflectors 131-134 mounted on the support substrate 150A, and four feeding elements 221, 222, 223, 224 (hereinbelow 221-224) and four reflectors 231, 232, 233, 234, (hereinbelow 231-234) mounted on the support substrate 150B.

The feeding elements 221-224 and the reflectors 231-234 are arranged on the surface on the Z-axis negative direction side of the support substrate 150B. The positions of the feeding elements 221-224 and the reflectors 231-234 in the X-axis direction and in the Y-axis direction are respectively the same as the positions of the feeding elements 121-124 and the reflectors 131-134 in the X-axis direction and in the Y-axis direction.

The positions of the feeding elements 221-224 and the reflectors 231-234 in the Z-axis direction are in positions that are symmetrical to the respective positions of the feeding elements 121-124 and the reflectors 131-134 in the Z-axis direction with respect to an XY-plane that passes through the center of the width in the Z-axis direction of the antenna element 110.

That is, the feeding elements 221-224 and the reflectors 231-234 and the feeding elements 121-124 and the reflectors 131-134 are respectively disposed in plane-symmetrical positions with respect to the XY-plane that passes through the center of the width in the Z-axis direction of the antenna element 110.

As a result, the support substrate 150B and the support substrate 150A are disposed in plane-symmetrical positions with respect to the XY-plane that passes through the center of the width in the Z-axis direction of the antenna element 110. The interval in the Z-axis direction between the feeding elements 121-124 and the reflectors 131-134 and the feeding elements 221-224 and the reflectors 231-234 is set to 5 mm as an example. In addition, the support substrates 150A and 150B may be attached to the wiring substrate 20 (see FIG. 2), to an inner wall of the casing 10A (see FIG. 1), or the like.

The feeding elements 221-224 are respectively connected to the four phase shifters 34-37 in the same way as the feeding elements 121-124. The phases that the four phase shifters connected to the feeding elements 221-224 apply to the input signals are adjusted by a CPU chip 240.

Figure 12B:
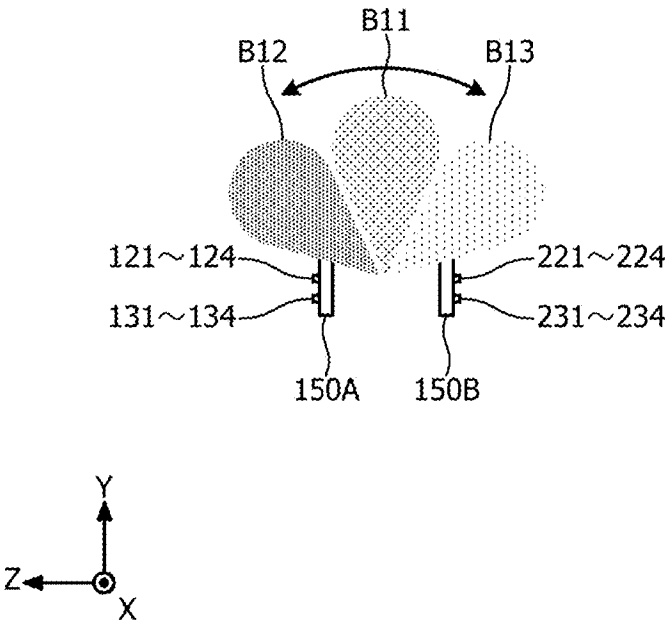
FIGS. 12A and 12B are views of beams radiated by the antenna array.
Figure 12A:
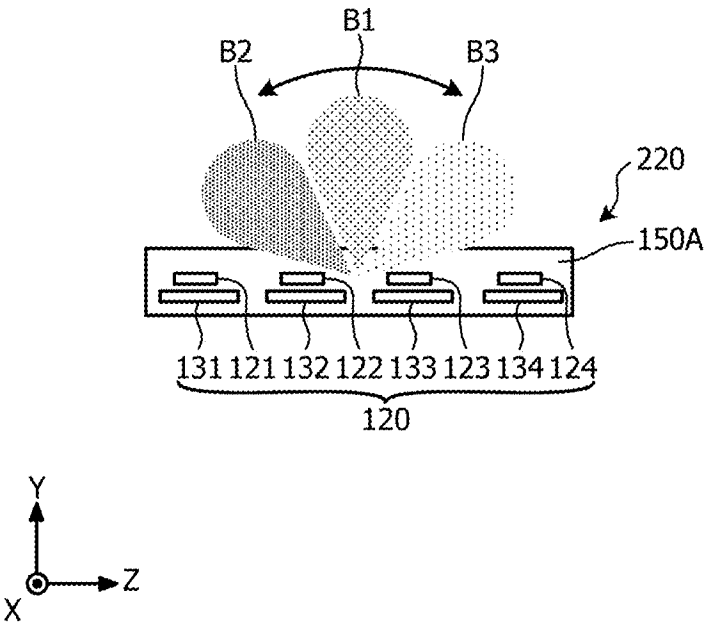

FIGS. 12A and 12B are views of beams radiated by the antenna array 220. FIG. 12A illustrates a state of the antenna array 220 as seen from the Z-axis positive direction side. Consequently, FIG. 12A illustrates the feeding elements 121-124, the reflectors 131-134, and the support substrate 150A of the antenna array 220.

The phase shifters connected to the feeding elements 121-124 and 221-224 adjust the phases applied to the input signals, whereby the angles of the beams may be changed within the XY-plane as depicted by beams B1, B2, and B3.

More specifically, equal phases are respectively applied to the four pairs of the feeding elements 121 and 221, the feeding elements 122 and 222, the feeding elements 123 and 223, and the feeding elements 124 and 224, which have equal positions in the X-axis direction, and phase differences are established for the phases applied to each of the pairs in the X-axis direction. Therefore, the angles of the beams may be changed within the XY-plane as depicted by the beams B1, B2, and B3.

FIG. 12B illustrates a state of the antenna array 220 as seen from the X-axis positive direction side. Consequently, FIG. 12B illustrates the feeding elements 121-124 and the reflectors 131-134 stacked on top of each other, and the feeding elements 221-224 and the reflectors 231-234 stacked on top of each other. FIG. 12B also illustrates the end surfaces in the X-axis positive direction side of the support substrates 150A and 150B.

The phase shifters connected to the feeding elements 121-124 and 221-224 adjust the phases applied to the input signals, whereby the angles of the beams may be changed within the YX-plane as depicted by the beams B11, B12, and B13.

More specifically, equal phases are respectively applied to the two pairs of the feeding elements 121-124 and the feeding elements 221-224, which are in equal positions in the Z-axis direction, and phase differences are established for the phases applied to both of the pair of the feeding elements 121-124 and the feeding elements 221-224. Therefore, the angles of the beams may be changed within the YZ-plane as depicted by the beams B11, B12, and B13.

As a result, the phases applied to the electromagnetic waves radiated from the feeding elements 121-124 and 221-224 may be adjusted separately, whereby the radiation direction of one beam may be changed within the XY-plane and within the YZ-plane.

Figure 13A:
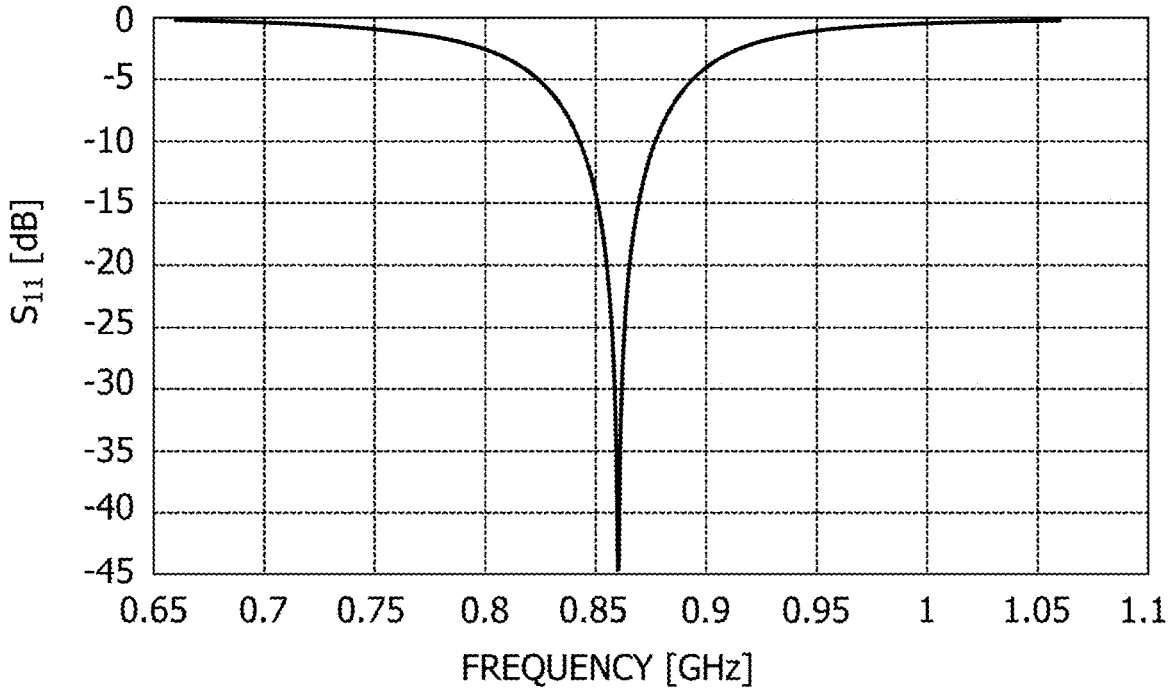
FIGS. 13A and 13B are views for illustrating simulation results of $S_{11}$ parameters and total efficiency of the antenna element.
Figure 13B:
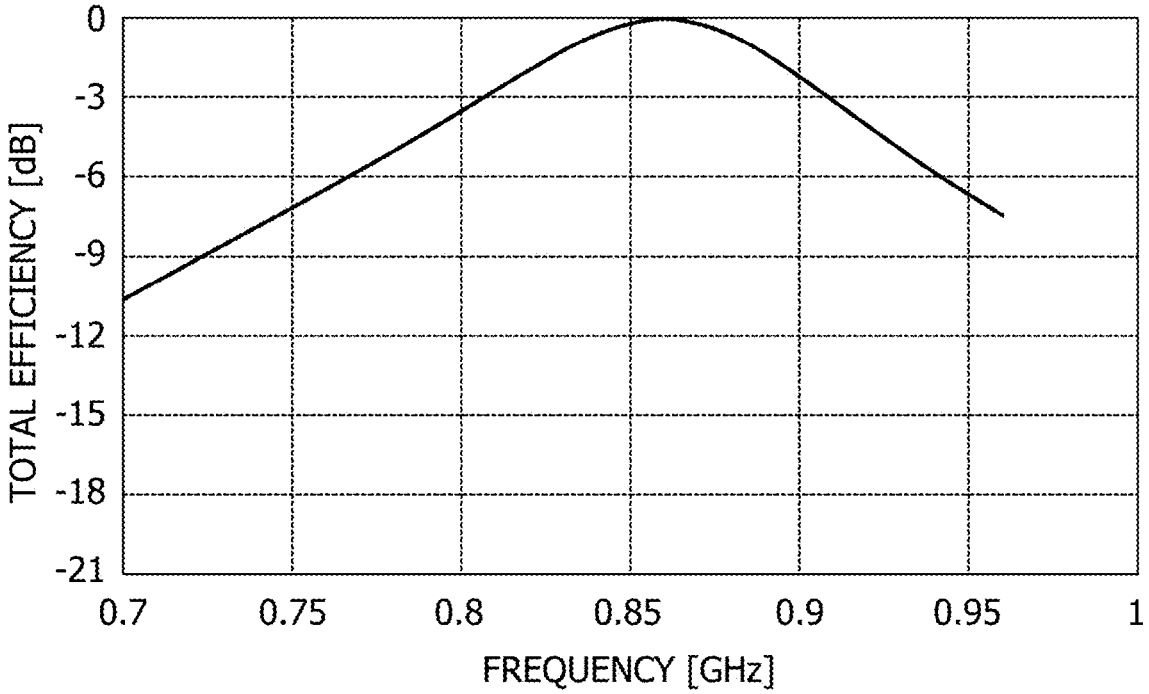

FIGS. 13A and 13B are views for illustrating simulation results of $S_{11}$ parameters and total efficiency of the antenna element 110.

As illustrated in FIG. 13A, the $S_{11}$ parameters of the antenna element 110 of the second embodiment are approximately −44 dB at 860 MHz and substantially the same results are obtained with the first embodiment.

As illustrated in FIG. 13B, the total efficiency of the antenna element 110 of the second embodiment is approximately 0 dB at 860 MHz and substantially the same results are obtained with the first embodiment.

According to the above results, it may be seen that there is almost no effect on the radiation characteristics of the antenna element 110 due to the addition of the antenna array 220.

Figure 14:
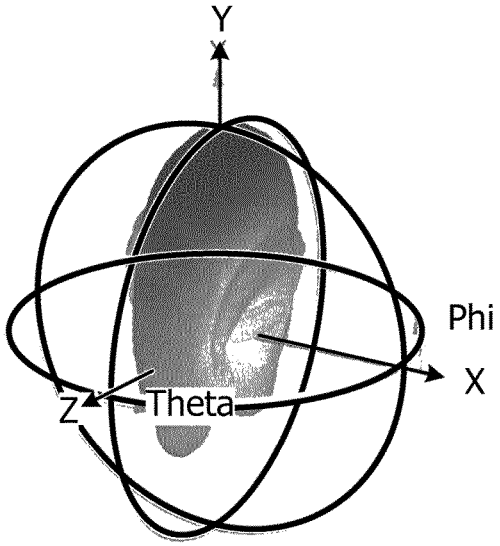
FIG. 14 is a view for illustrating simulation results of a radiation pattern of an antenna array according to the second embodiment.

FIG. 14 is a view for illustrating simulation results of a radiation pattern (absolute gain characteristics) of the antenna array 220 according to the second embodiment. As illustrated in FIG. 14, directionality in the Y-axis positive direction is depicted and it may be seen that a beam having a high intensity is radiated in the Y-axis positive direction.

Figure 15:
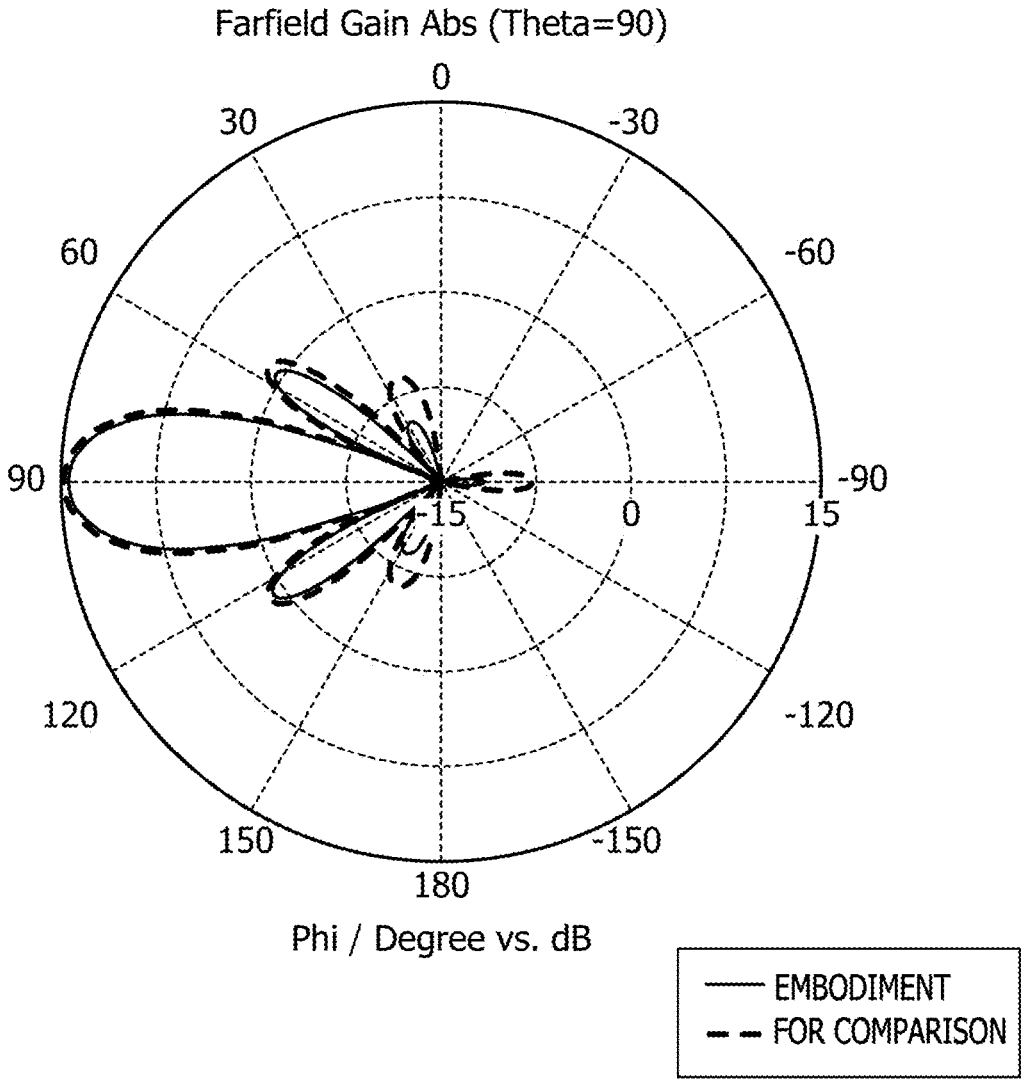
FIG. 15 is a view for illustrating simulation results of a radiation pattern on the XY*plane of the antenna array according to the second embodiment.

FIG. 15 is a view for illustrating simulation results of a radiation pattern (absolute gain characteristics) on the XY-plane of the antenna array 220 according to the second embodiment. The radiation characteristics are characteristics obtained when Theta (θ) in FIG. 14 is fixed and Phi (φ) is oscillated.

The radiation pattern is illustrated herein for comparison of the antenna array 220 in an antenna device with the antenna element 110 removed from the antenna device 200. The radiation characteristics of the antenna array 220 of the second embodiment are represented by the solid lines and the radiation characteristics of the antenna array 220 for comparison are represented by dashed lines in FIG. 15.

As illustrated in FIG. 15, the directionality of radiation characteristics of the antenna array 220 of the second embodiment is depicted in the Y-axis positive direction (90-degree direction) and it may be seen that a beam having a high intensity is radiated in the Y-axis positive direction. The above characteristics are substantially the same as the radiation characteristics of the antenna element 110 for comparison depicted with the dashed lines.

Therefore according to the second embodiment, a configuration may be realized in which almost no adverse effects are felt between the antenna element 110 that communicates in the UHF band and the antenna array 220 that communicates in the submillimeter wave (millimeter wave) band due to the disposition of the feeding elements 121-124 of the antenna array 220 that communicates in the submillimeter wave (millimeter wave) band, adjacent to the line 112 of the antenna element 110. The heights on the Y-axis direction of the line 112 and the feeding elements 121-124 match each other with respect to the edge side 50A of the ground plane 50.

Furthermore, because the antenna element 110 and the antenna array 220 are radiation elements that are separate without being connected to each other, the radiation characteristics of the antenna element 110 and the radiation characteristics of the antenna array 220 may be adjusted separately.

Therefore, an antenna device 200 and a smartphone terminal device 10 (wireless communication device) may be provided in which the radiation characteristics of an antenna element for low frequencies and the radiation characteristics of an antenna element for high frequencies may be adjusted separately.

Moreover, the feeding elements 121-124 and the feeding elements 221-224 in the antenna device 200 of the second embodiment are aligned in the Z-axis direction. Therefore, the radiation direction of one beam may be changed within the XY-plane and within the YZ-plane.

In particular, because the beam direction of the antenna array 220 for 5G wavers, the ability to adjust the radiation characteristics separately from the antenna element 110 is desirable.

Third Embodiment

Figure 16A:
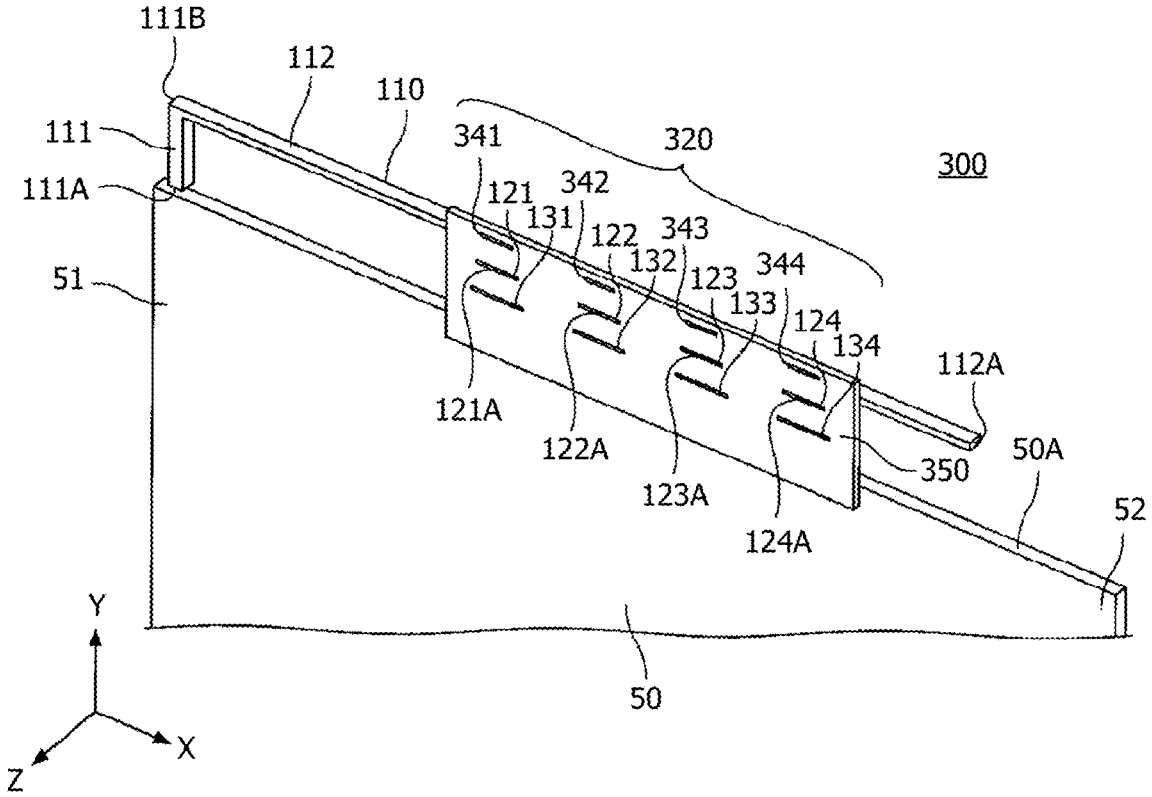
FIGS. 16A and 16B are perspective views of an antenna device according to a third embodiment.
Figure 16B:
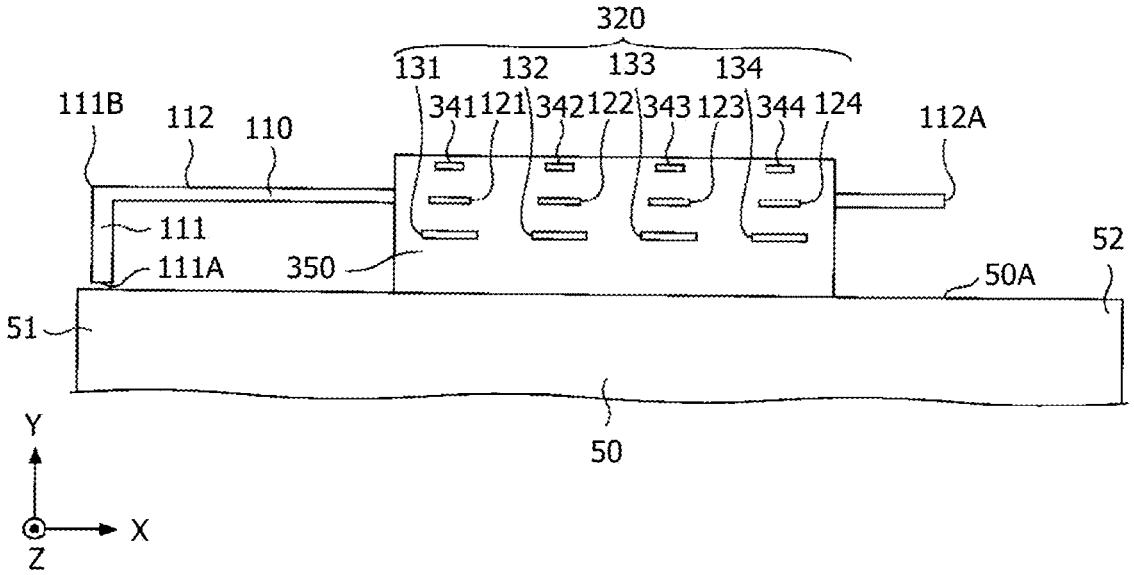

FIGS. 16A and 16B are perspective views of an antenna device 300 according to a third embodiment. FIGS. 16A and 16B illustrate a portion corresponding to the antenna devices 100 and 200 illustrated in FIGS. 4A to 4C, 11A and 11B in the first and second embodiments. FIGS. 16A and 16B are perspective view and FIG. 16B is a view illustrating a configuration on the XY-plane. The same XYZ coordinates as the first and second embodiments are used in the third embodiment in the following explanation. Configuration elements that are the same as the configuration items of the first and second embodiments are given the same reference numeral and explanations thereof will be omitted.

The antenna device 300 includes the ground plane 50, the antenna element 110, and an antenna array 320, and a support substrate 350. While the antenna device 300 may further include the wiring substrate 20 (see FIG. 2) in addition to the aforementioned configuration elements, illustration of the wiring substrate 20 is omitted in FIG. 16.

The antenna array 320 has the four feeding elements 121-124, the four reflectors 131-134, and four wave directors 341, 342, 343, 344 (hereinbelow, 341-344).

The wave directors 341-344 are disposed on the surface in the Z-axis positive direction side of the support substrate 350. The wave directors 341-344 correspond respectively to the feeding elements 121-124 and are disposed further in the Y-axis positive direction than the feeding elements 121-124.

The lengths in the X-axis direction of the wave directors 341-344 are slightly shorter than the lengths in the X-axis direction of the feeding elements 121-124. The centers along the length in the X-axis direction of the wave directors 341-344 are disposed so as to match the feeding points 121A-124A of the feeding elements 121-124 in the X-axis direction.

In addition, the interval in the Y-axis direction between the wave directors 341-344 and the feeding elements 121-124 is shorter than the interval in the Y-axis direction between the feeding elements 121-124 and the reflectors 131-134.

By using the aforementioned wave directors 341-344, the electromagnetic waves radiated in the Y-axis positive direction by the feeding elements 121-124 may be guided in the direction of the wave directors 341-344, whereby the directionality of the feeding elements 121-124 is set to the Y-axis positive direction and gain may be increased.

The dimensions of each unit include, as an example, the length in the X-axis direction of the feeding elements 121-124 being 3.4 mm ($0.317\lambda_2$), the length in the X-axis direction of the reflectors 131-134 being 3.55 mm ($0.33\lambda_2$), and the length in the X-axis direction of the wave directors 341-344 being 3.1 mm ($0.289\lambda_2$). In addition, the interval in the Y-axis direction between the feeding elements 121-124 and the reflectors 131-134 is 1.9 mm ($0.177\lambda_2$), and the interval in the Y-axis direction between the feeding elements 121-124 and the wave directors 341-344 is 1.9 mm ($0.177\lambda_2$).

Figure 17:
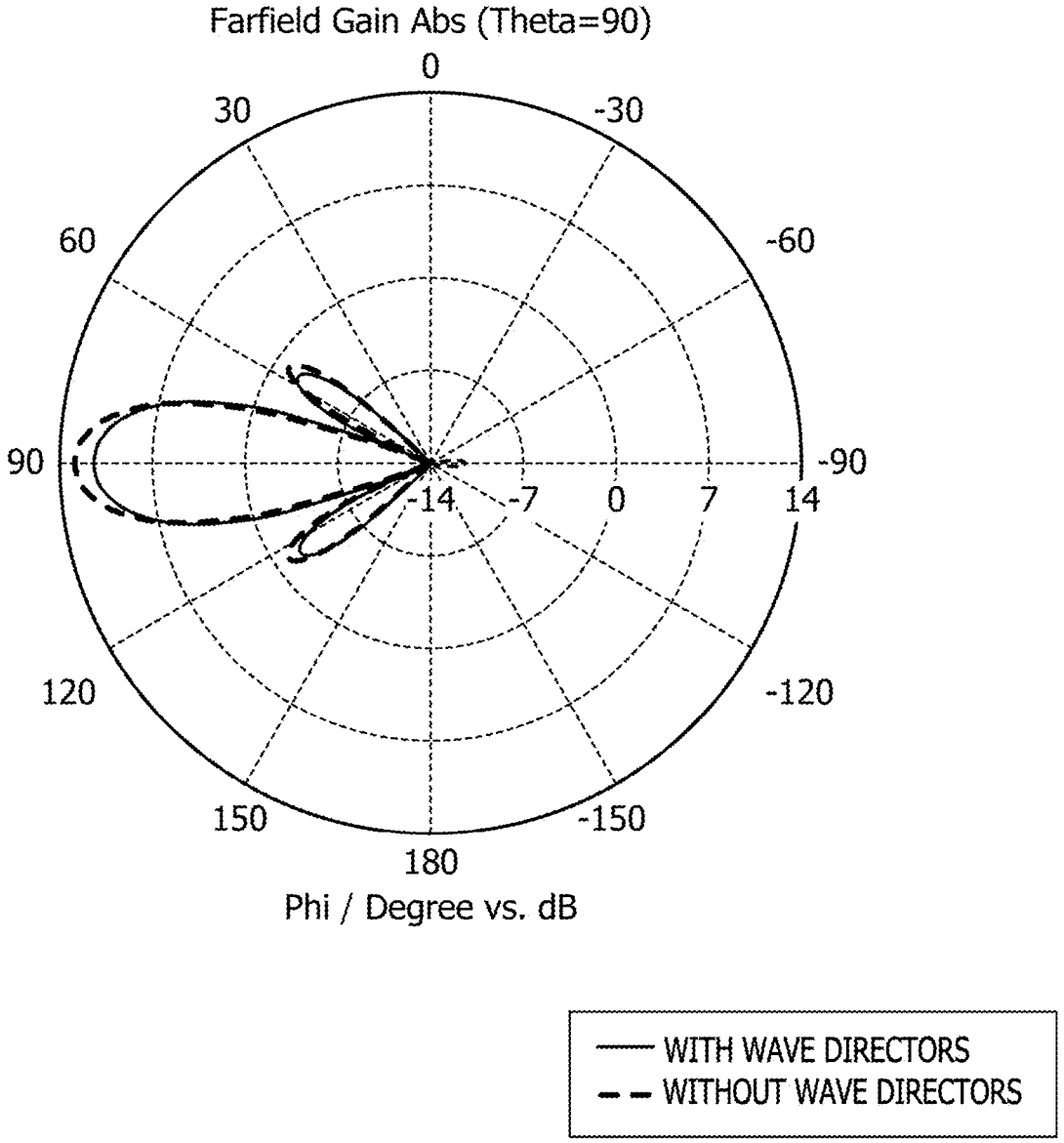
FIG. 17 is a view for illustrating simulation results of a radiation pattern on the XY-plane of the antenna array according to the third embodiment.

FIG. 17 is a view for illustrating simulation results of a radiation pattern (absolute gain characteristics) on the XY-plane of the antenna array 320 according to the third embodiment. The radiation characteristics of the antenna array 320 of the third embodiment are represented by solid lines and the radiation characteristics of the antenna array 320 in an antenna device with the wave directors 341-344 removed from antenna device 300 for comparison are represented by dashed lines in FIG. 17.

As illustrated in FIG. 17, the directionality of radiation characteristics of the antenna array 320 of the third embodiment is depicted in the Y-axis positive direction (90-degree direction) and it may be seen that a beam having a high intensity is radiated in the Y-axis positive direction. The above characteristics are substantially the same as the radiation characteristics of the antenna array 320 for comparison depicted with the dashed lines.

Therefore according to the third embodiment, a configuration may be realized in which almost no adverse effects are felt between the antenna element 110 that communicates in the UHF band and the antenna array 320 that communicates in the submillimeter wave (millimeter wave) band due to the disposition of the feeding elements 121-124 of the antenna array 320 that communicates in the submillimeter wave (millimeter wave) band, adjacent to the line 112 of the antenna element 110. The heights on the Y-axis direction of the line 112 and the feeding elements 121-124 match each other with respect to the edge side 50A of the ground plane 50. The antenna array 320 also has the wave directors 341-344.

Furthermore, because the antenna element 110 and the antenna array 320 are radiation elements that are separate without being connected to each other, the radiation characteristics of the antenna element 110 and the radiation characteristics of the antenna array 320 may be adjusted separately.

Therefore, the antenna device 300 and the smartphone terminal device 10 (wireless communication device) may be provided in which the radiation characteristics of the antenna element for low frequencies and the radiation characteristics of the antenna element for high frequencies may be adjusted separately.

Moreover, the antenna device 300 of the third embodiment includes the wave directors 341-344 and therefore a beam with a high intensity may be radiated from the Y-axis positive direction.

While a mode in which the antenna array 320 of the antenna device 300 includes the reflectors 131-134 has been explained above, the antenna array 320 may be configured to include the feeding elements 121-124 and the wave directors 341-344 without including the reflectors 131-134.

Fourth Embodiment

Figure 18:
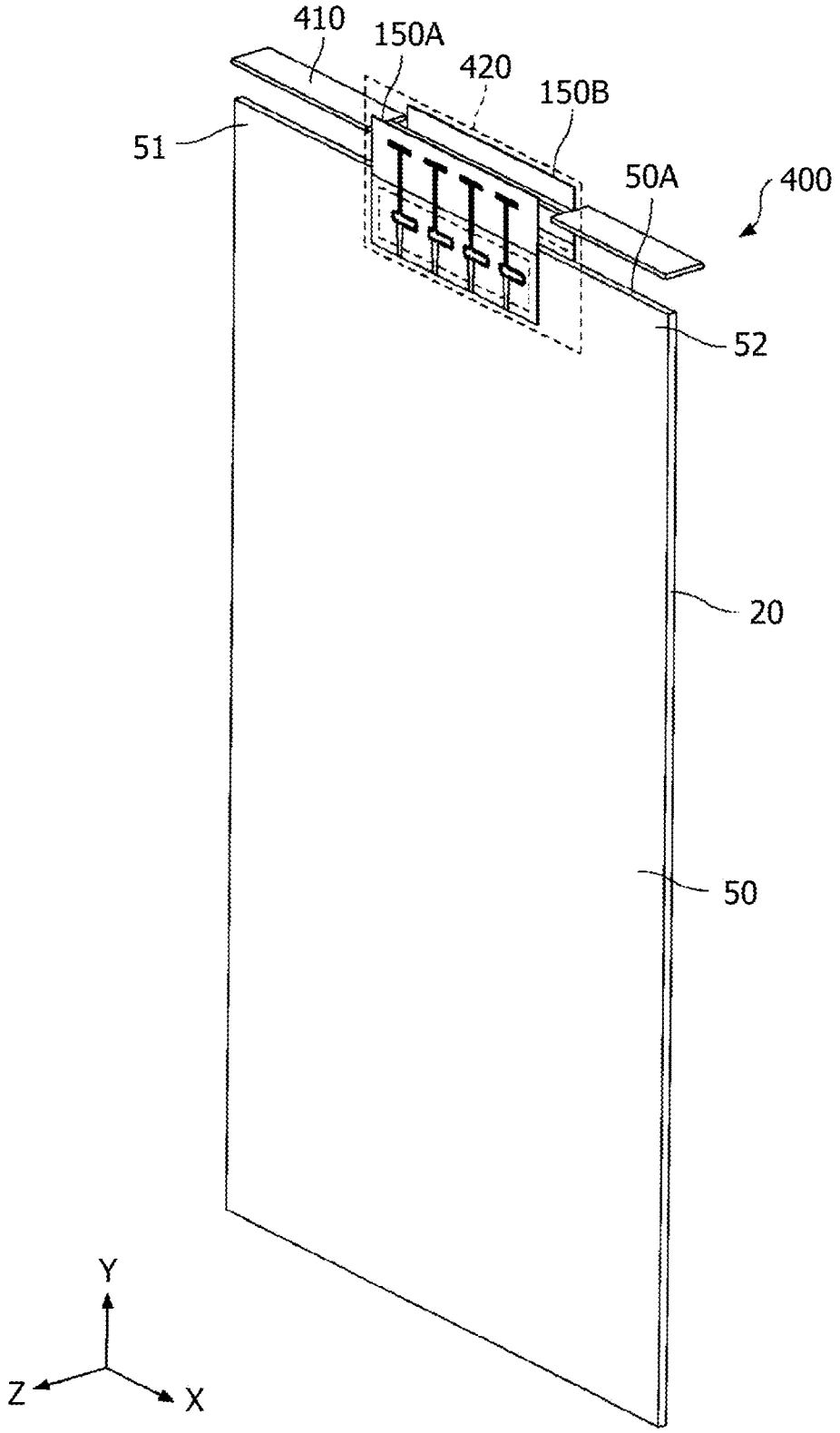
FIG. 18 is a perspective view of an antenna device according to a fourth embodiment.
Figure 19:
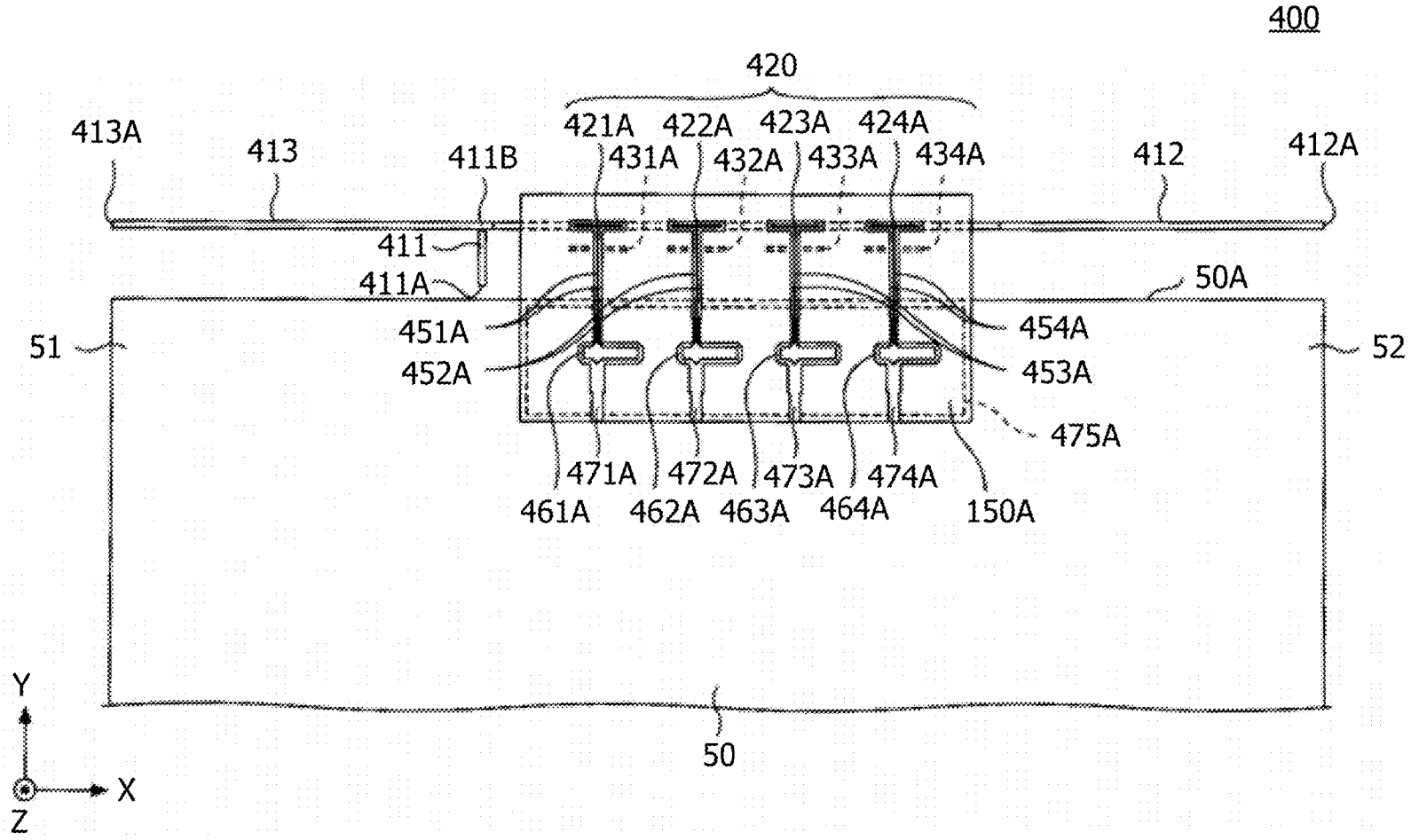
FIG. 19 is a plan view of an enlargement of a portion of FIG. 18.
Figure 20:
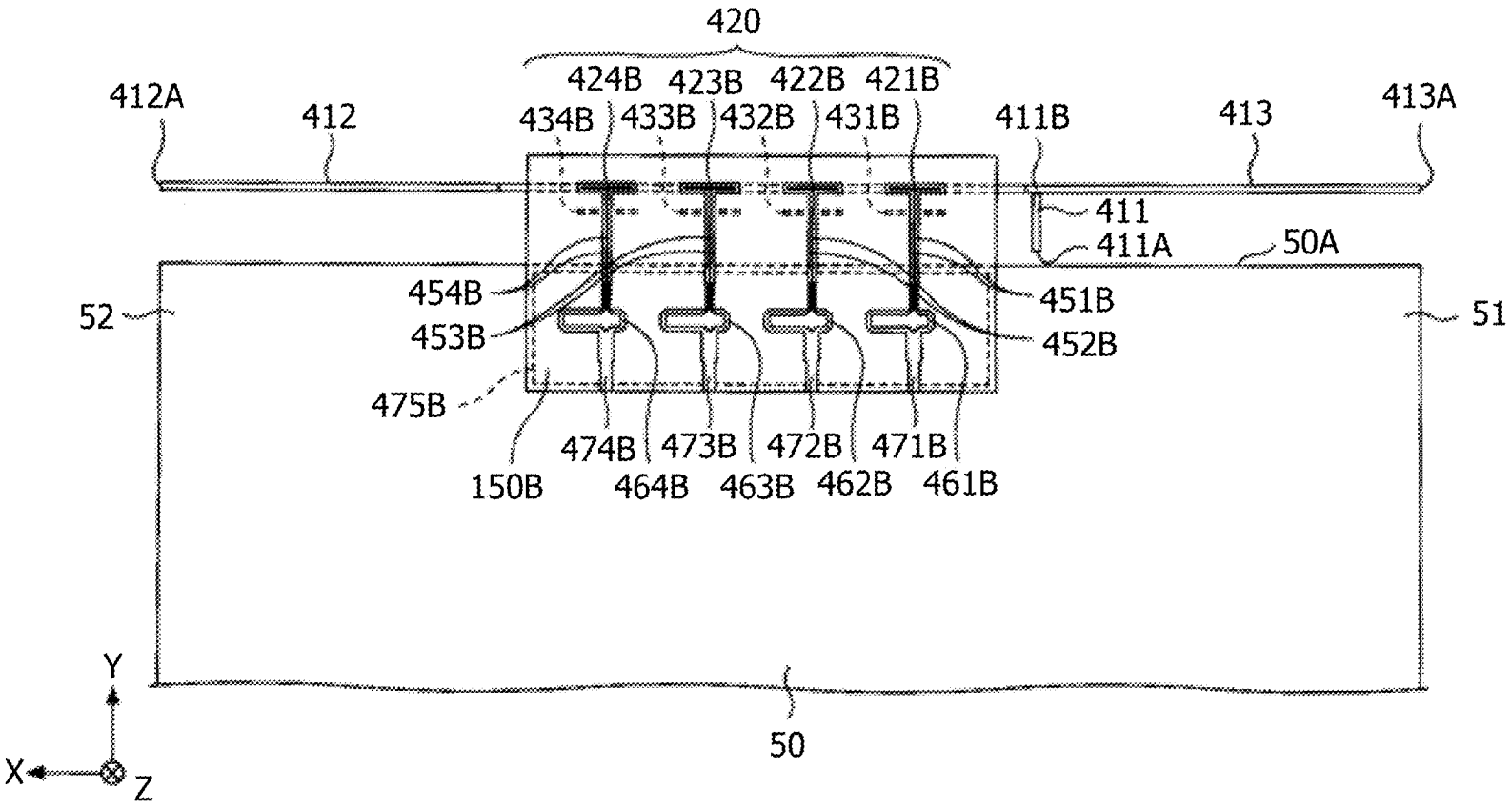
FIG. 20 is a plan view of an enlargement of a portion of FIG. 18.

FIG. 18 is a perspective view of an antenna device 400 according to a fourth embodiment. FIGS. 19 and 20 are plan views of enlargements of portions of FIG. 18. FIG. 19 is a view as seen from the Z-axis positive direction side and FIG.

20 is a view as seen from the Z-axis negative direction side. The same XYZ coordinates as the first embodiment are used in the fourth embodiment in the following explanation. Configuration elements that are the same as the configuration items of the first embodiment are given the same reference numeral and explanations thereof will be omitted.

The antenna device 400 has a configuration in which the L-shaped antenna device 200 of the second embodiment is replaced with a T-shaped antenna element 410, and the antenna array 220 is replaced with an antenna array 420.

The antenna element 410 has lines 411, 412, and 413, a feeding point 411A, and open ends 412A and 413A.

The line 411 extends in the Y-axis positive direction from the feeding point 411A that is disposed in the proximity of the edge side 50A of the ground plane 50, and is connected to the lines 412 and 413 with a connection part 411B. The feeding point 411A is positioned, in the X-axis direction, further to the X-axis negative direction side than the center point along the length in the X-axis direction of the edge side 50A.

The line 412 extends from the connection part 411B to the open end 412A in the X-axis positive direction. The position in the X-axis direction of the open end 412A is substantially equal to the apex 52. The line 413 extends from the connection part 411B to the open end 413A in the X-axis negative direction. The position in the X-axis direction of the open end 413A is substantially equal to the apex 51.

The length of the antenna element 410 from the feeding point 411A through the connection part 411B to the open end 412A is set to a quarter wavelength ($\lambda_{1A}/4$) of the electrical length $\lambda_{1A}$ of the wavelength at a communication frequency f1A.

Further, the length of the antenna element 410 from the feeding point 411A through the connection part 411B to the open end 413A is set to a quarter wavelength ($\lambda_{1B}/4$) of the electrical length $\lambda_{1B}$ of the wavelength at a communication frequency f1B.

The communication frequencies f1A and f1B are both frequencies that belong to the UHF band and the communication frequency f1B is higher than the communication frequency f1A.

The antenna array 420 has four feeding elements 421A, 422A, 423A, 424A (hereinbelow 421A-424A) and four reflectors 431A, 432A, 433A, 434A, (hereinbelow 431A-434A) mounted on the support substrate 150A.

In addition, the antenna array 420 has four feeding elements 421B, 422B, 423B, 424B (hereinbelow 421B-424B) and four reflectors 431B, 432B, 433B, 434B (hereinbelow 431B-434B) mounted on the support substrate 150B.

The feeding elements 421A-424A and 421B-424B are a folded dipole antenna. The feeding elements 421A-424A are disposed on the surface on the Z-axis positive direction side of the support substrate 150A, and the reflectors 431A-434A are disposed on the surface on the Z-axis negative direction side of the support substrate 150A. The feeding elements 421B-424B are disposed on the surface on the Z-axis negative direction side of the support substrate 150A, and the reflectors 431B-434B are disposed on the surface on the Z-axis positive direction side of the support substrate 150A.

Figure 21:
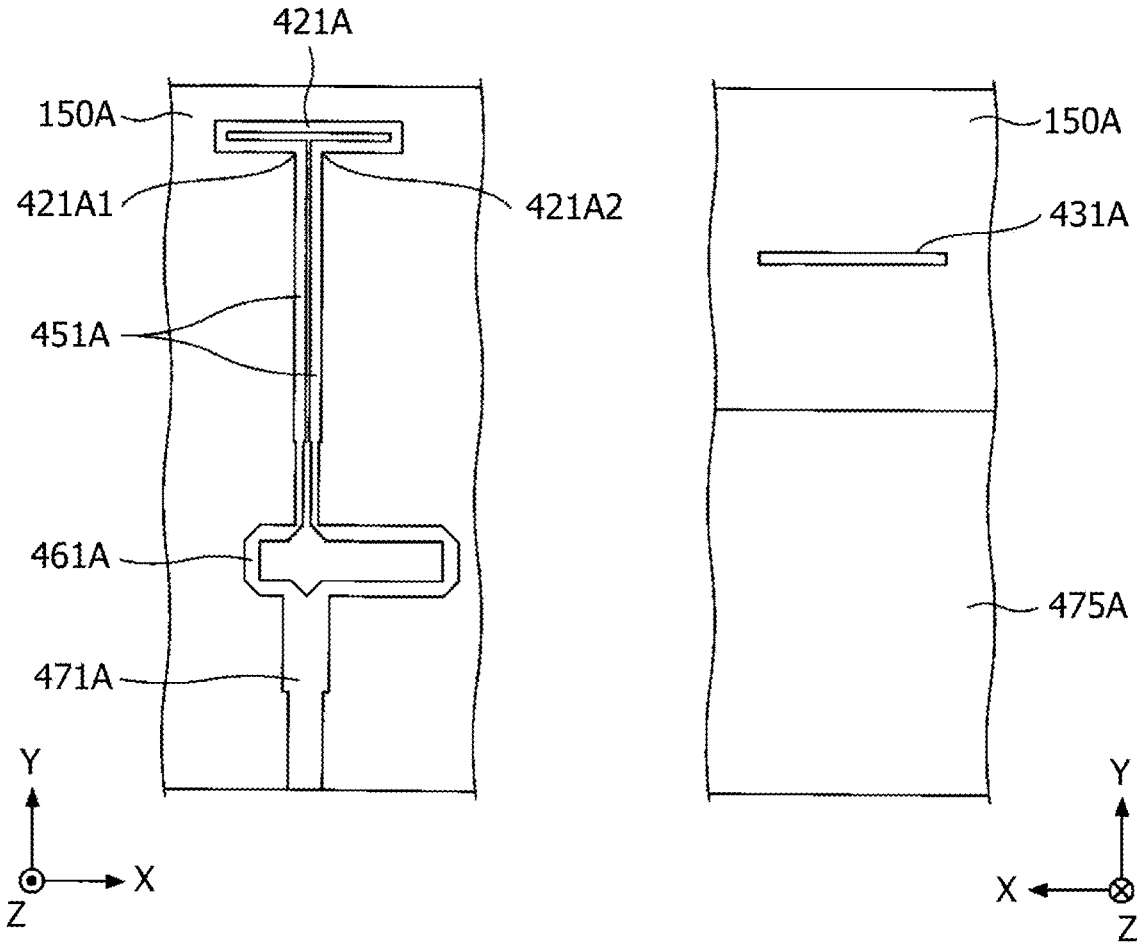
FIG. 21 is a view illustrating an enlargement of a feeding element and the surrounding configuration elements.

The following explanation will use FIG. 21 in addition to FIG. 18-20. FIG. 21 is a view illustrating an enlargement of the feeding element 421 and the surrounding configuration elements.

The antenna device 400 includes parallel lines 451A, 452A, 453A, 454A (hereinbelow, 451A-454A), baluns 461A, 462A, 463A, 464A (hereinbelow, 461A-464A), and micro strip lines 471A, 472A, 473A, 474A (hereinbelow, 471A-474A) as configuration elements for feeding power to the feeding elements 421A-424A of the antenna array 420.

The micro strip lines 471A-474A include a ground layer 475A arranged on the surface on the Z-axis negative direction side of the support substrate 150A. The ground layer 475A is disposed in a region that is substantially half of the Y-axis negative direction side within the surface on the Z-axis negative direction side of the support substrate 150A.

In addition, the antenna device 400 includes parallel lines 451B, 452B, 453B, 454B (hereinbelow, 451B-454B), baluns 461B, 462B, 463B, 464B (hereinbelow, 461B-464B), and micro strip lines 471B, 472B, 473B, 474B (hereinbelow, 471B-474B) as configuration elements for feeding power to the feeding elements 421B-424B of the antenna array 420.

The micro strip lines 471B-474B include a ground layer 475B arranged on the surface on the Z-axis negative direction side of the support substrate 150B. The ground layer 475B is disposed in a region that is substantially half of the Y-axis negative direction side within the surface on the Z-axis negative direction side of the support substrate 150B.

The feeding elements 421A-424A are connected to the micro strip lines 471A-474A through the parallel lines 451A-454A and the baluns 461A-464A. Similarly, the feeding elements 421B-424B are connected to the micro strip lines 471B-474B through the parallel lines 451B-454B and the baluns 461B-464B.

More specifically, the feeding element 421A has feeding points 421A1 and 421A2, and the parallel line 451A is connected to the feeding points 421A1 and 421A2. The parallel line 451A is connected to the micro strip line 471A through the balun 461A. The micro strip line 471A is connected to the wire 25A (see FIG. 2).

The aforementioned configuration is respectively the same for the feeding elements 422A-424A and 421B-424B.

Figure 22:
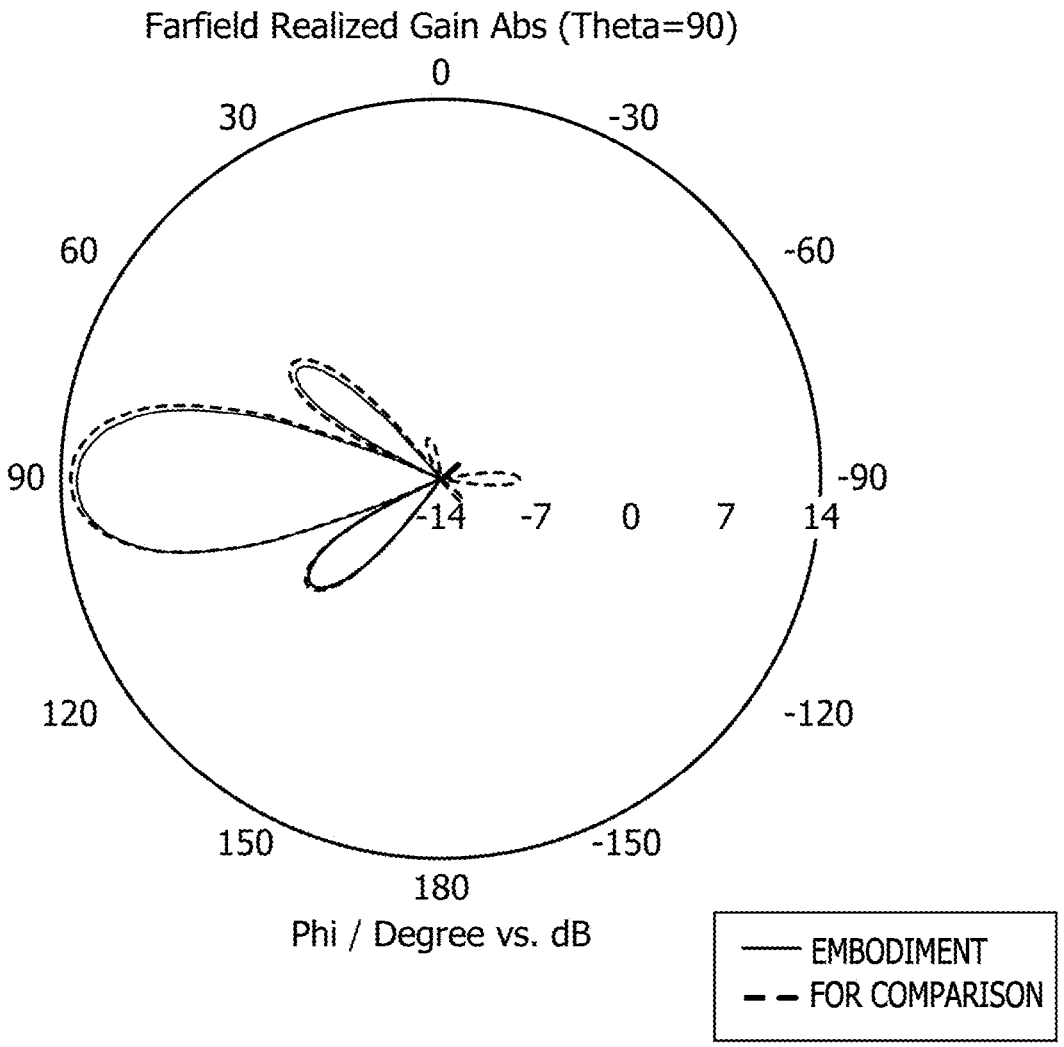
FIG. 22 is a view for illustrating simulation results of a radiation pattern on the XY-plane of the antenna array according to the fourth embodiment.

FIG. 22 is a view for illustrating simulation results of a radiation pattern (absolute gain characteristics) on the XY-plane of the antenna array 420 according to the fourth embodiment.

A radiation pattern of the antenna array 420 in an antenna device with the antenna element 410 removed from the antenna device 400 is illustrated herein for comparison.

The radiation characteristics of the antenna array 420 of the fourth embodiment are represented by solid lines and the radiation characteristics of the antenna array 420 for comparison are represented by dashed lines in FIG. 22.

As illustrated in FIG. 22, the directionality of the radiation characteristics of the antenna array 420 of the fourth embodiment is depicted in the Y-axis positive direction (90-degree direction) and it may be seen that a beam having a high intensity is radiated in the Y-axis positive direction. The above characteristics are substantially the same as the radiation characteristics of the antenna array 420 for comparison depicted with the dashed lines.

Therefore according to the fourth embodiment, a configuration may be realized in which almost no adverse effects are felt between the antenna element 410 that communicates in the two UHF bands of the communication frequencies f1A and f1B and the antenna array 420 that communicates in the submillimeter wave (millimeter wave) band due to the disposition of the feeding elements 421A-424A and 421B-424B of the antenna array 420 that communicates in the submillimeter wave (millimeter wave) band, adjacent to the line 412 of the antenna element 410. The heights on the Y-axis direction of the line 412 and the feeding elements 421A-424A and 421B-424B match each other with respect to the edge side 50A of the ground plane 50.

Furthermore, because the antenna element 410 and the antenna array 420 are radiation elements that are separate without being connected to each other, the radiation characteristics of the antenna element 410 and the radiation characteristics of the antenna array 420 may be adjusted separately.

Therefore, the antenna device 400 and the smartphone terminal device 10 (wireless communication device) may be provided in which the radiation characteristics of the antenna element for low frequencies and the radiation characteristics of the antenna element for high frequencies may be adjusted separately.

Moreover, the feeding elements 421A-424A and the feeding elements 421B-424B in the antenna device 400 of the fourth embodiment are aligned in the Z-axis direction. Therefore, the radiation direction of one beam may be changed within the XY-plane and within the YZ-plane.

In particular, because the beam direction of the antenna array 420 for 5G wavers, the ability to adjust the radiation characteristics separately from the antenna element 410 is desirable.

Fifth Embodiment

Figure 23:
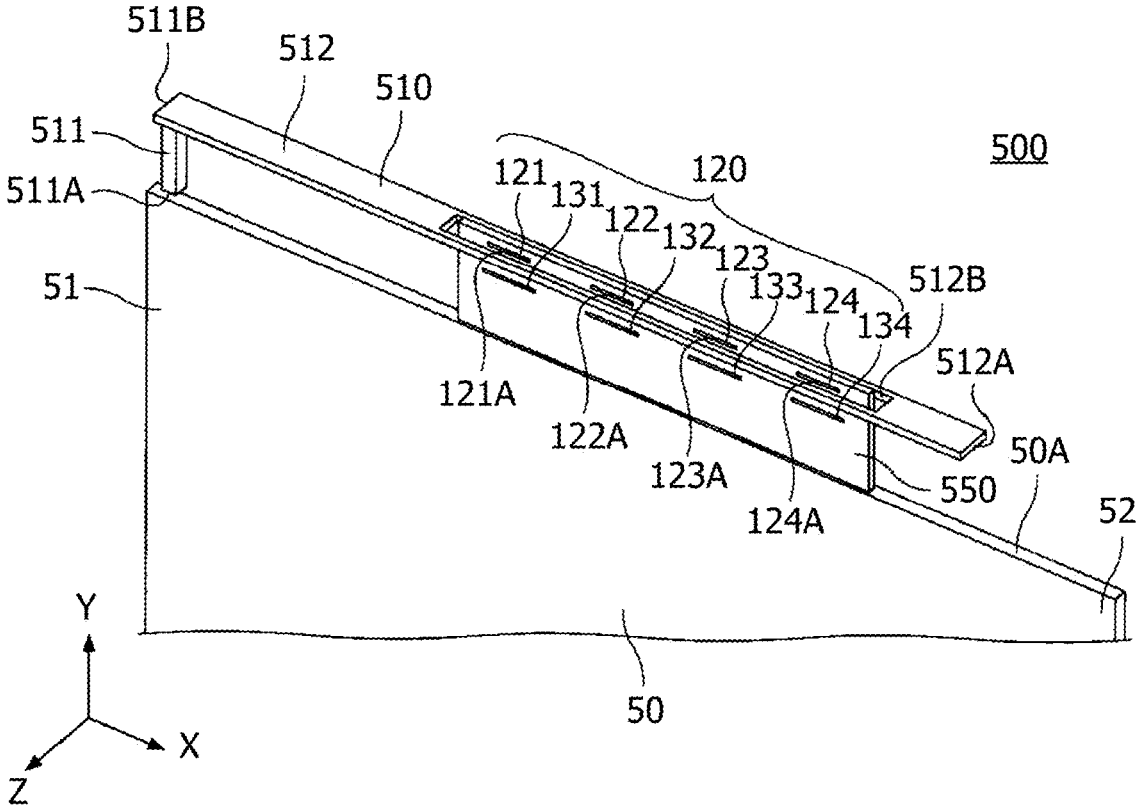
FIG. 23 is a perspective view of an antenna device according to a fifth embodiment.
Figure 24:
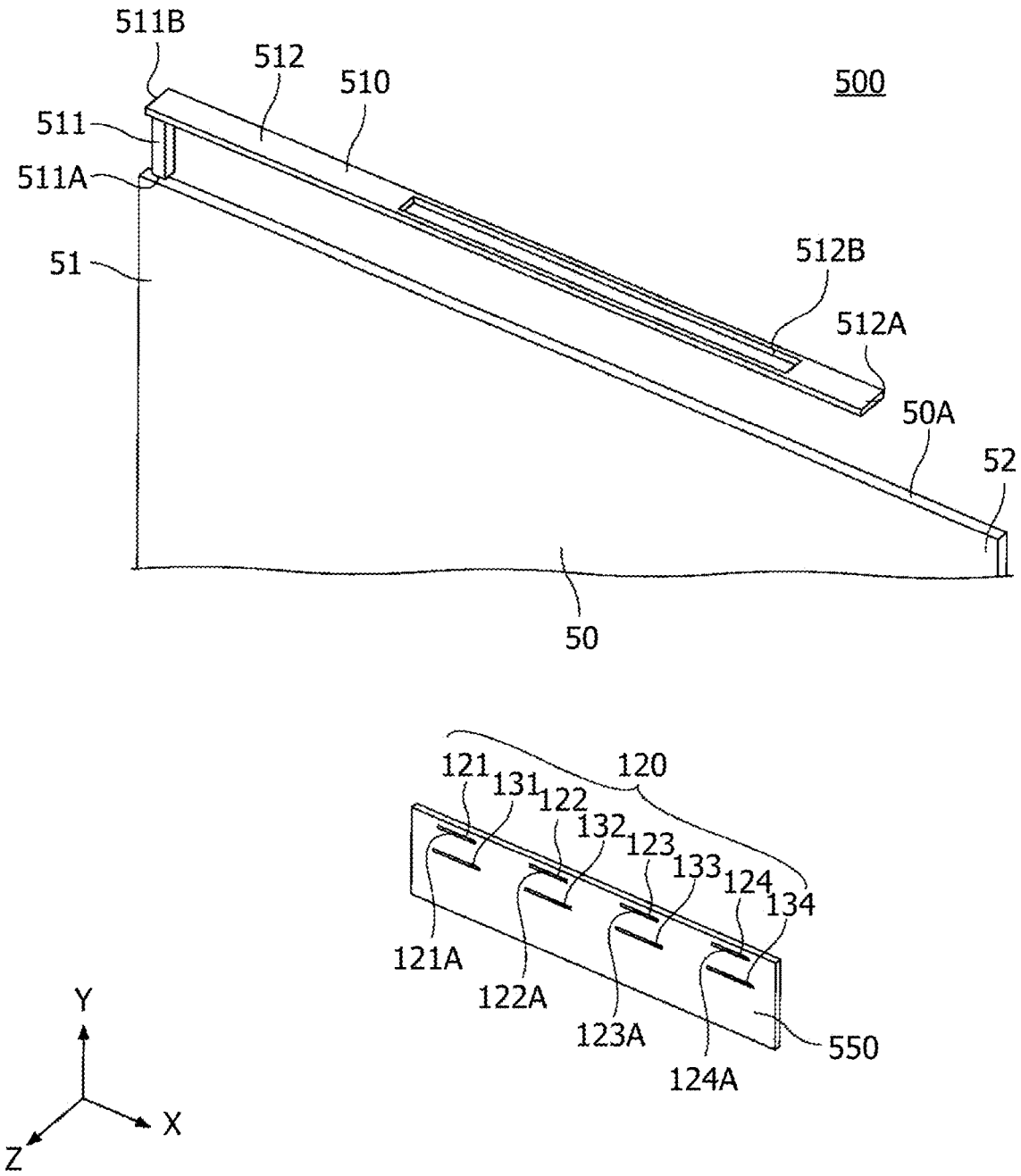
FIG. 24 is an exploded view of the antenna device according to the fifth embodiment.

FIG. 23 is a perspective view of an antenna device 500 according to a fifth embodiment. FIG. 23 is a view that corresponds to FIG. 4(A) of the first embodiment. FIG. 24 is an exploded view of the antenna device 500 according to the fifth embodiment. The same XYZ coordinates as the first to fourth embodiments are used in the fifth embodiment in the following explanation. Configuration elements that are the same as the configuration items of the first embodiment are given the same reference numeral and explanations thereof will be omitted.

The antenna device 500 includes the ground plane 50, an antenna element 510, the antenna array 120, and a support substrate 550. While the antenna device 500 may further include the wiring substrate 20 (see FIG. 2) in addition to the aforementioned configuration elements, illustration of the wiring substrate 20 is omitted in FIG. 23.

The antenna device 500 is one in which the antenna element 110 and the support substrate 150 of the antenna device 100 of the first embodiment are replaced respectively by the antenna element 510 and the support substrate 550.

The antenna element 510 is an L-shaped monopole antenna element having a line 511, a feeding point 511A, a bent part 511B, a line 512, and an open end 512A. The antenna element 510 is an example of a first antenna element.

The antenna element 510 includes a slit 512B in the line 512 and therefore is different from the antenna element 110. The slit 512B has an opening size that allows the support substrate 550 to pass therethrough. Moreover, the antenna element 510 has a greater width in the Z-axis direction than the antenna element 110 of the first embodiment because the antenna element 510 has the slit 512B that allows the support substrate 550 to pass therethrough.

The support substrate 550 has a length in the X-axis direction and a thickness in the Z-axis direction that are the same as the support substrate 150 of the first embodiment. The support substrate 550 may be attached to the edge side 50A of the ground plane 50, may be attached to the wiring substrate 20 (see FIG. 2), or may be attached to the casing 10A (see FIG. 1).

The feeding elements 121-124 and the reflectors 131-134 of the antenna array 120 are arranged on the surface in the Z-axis positive direction side of the support substrate 550. The positions of the feeding elements 121-124 and the reflectors 131-134 with respect to the antenna element 510 in the XY-plane are the same as the positions of the feeding elements 121-124 and the reflectors 131-134 with respect to the antenna element 110 in the XY-plane in the first embodiment. That is, the positions in the Y-axis direction of the feeding elements 121-124 and the line 512 of the antenna element 510 are aligned.

Furthermore, because the antenna element 510 and the antenna array 120 are radiation elements that are separate without being connected to each other, the radiation characteristics of the antenna element 510 and the radiation characteristics of the antenna array 120 may be adjusted separately. The radiation characteristics discussed herein include the radiation pattern and/or the impedance.

Therefore, the antenna device 500 and the smartphone terminal device 10 (wireless communication device) may be provided in which the radiation characteristics of the antenna element for low frequencies and the radiation characteristics of the antenna element for high frequencies may be adjusted separately.

Figure 25:
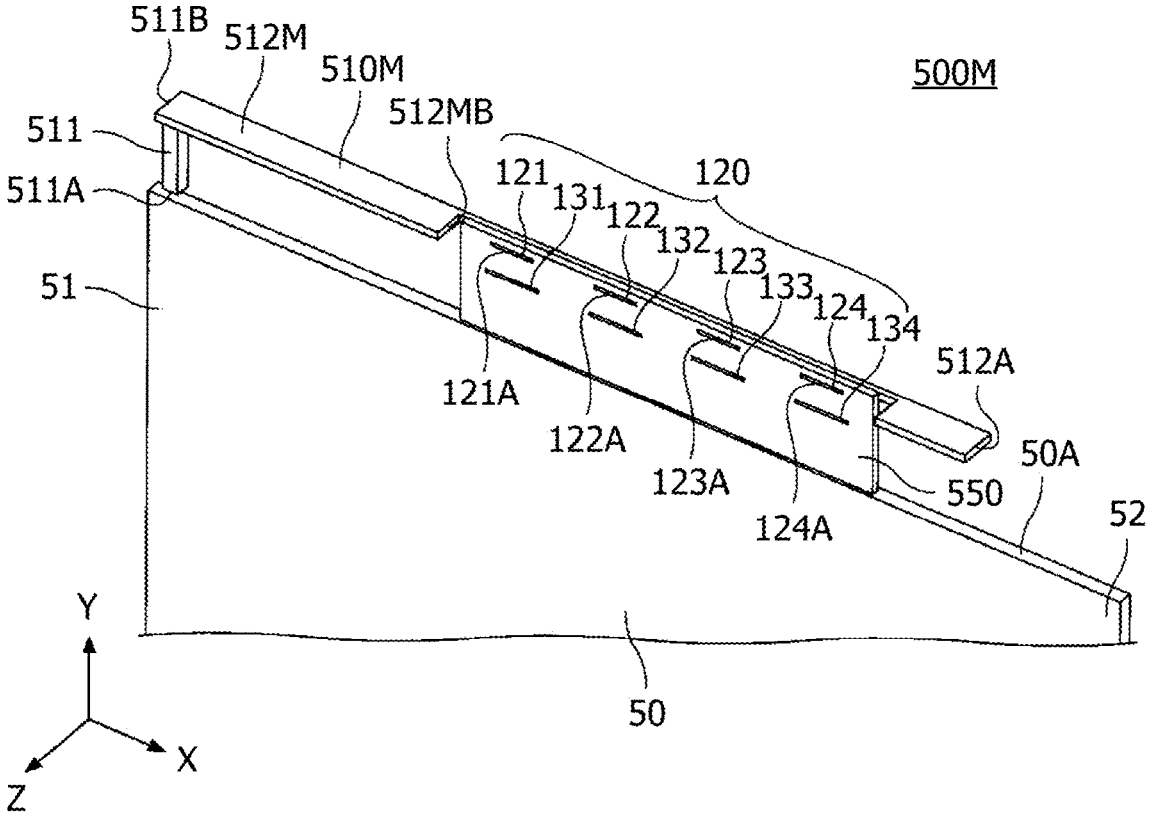
FIG. 25 is a view of an antenna device according to a modified example of the fifth embodiment.
Figure 26:
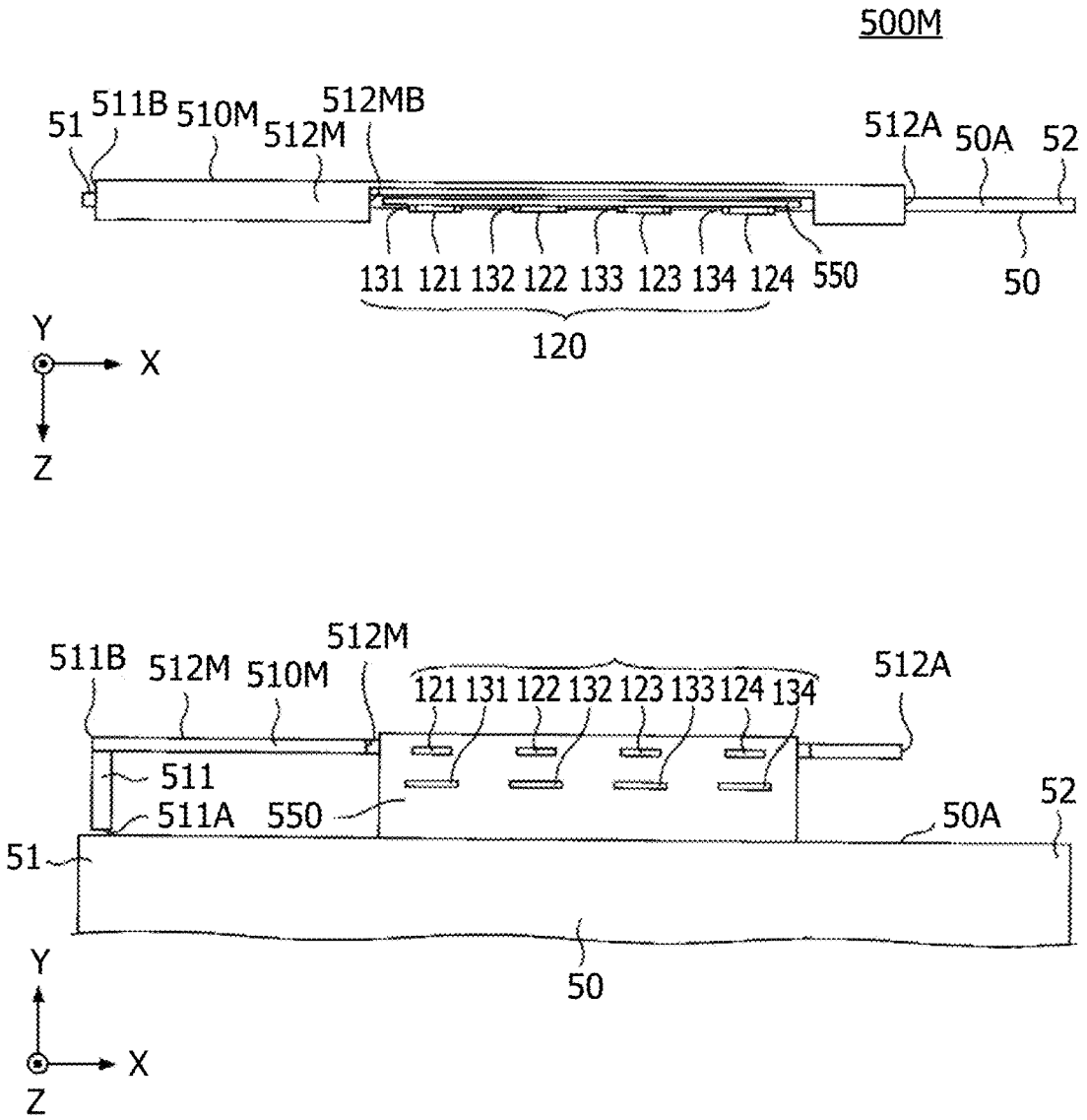
FIG. 26 is a view of the antenna device according to the modified example of the fifth embodiment.

FIGS. 25 and 26 are views of an antenna device 500M according to a modified example of the fifth embodiment. FIG. 25 is a perspective view, FIG. 26(A) is an above view (XZ-plane view), and FIG. 26(B) is a plan view.

The antenna device 500M is one in which the antenna element 510 of the antenna device 500M is replaced respectively by an antenna element 510M.

The antenna element 510M is a reverse L-shaped monopole antenna element having a line 511, the feeding point 511A, the bent part 511B, a line 512M, and the open end 512A. The antenna element 510 is an example of a first antenna element.

The line 512M is configured to have a notch 512MB in place of the slit 512B in the line 512 illustrated in FIGS. 23 and 24. The support substrate 550 passes through the notch 512MB of the line 512M.

The positions of the feeding elements 121-124 and the reflectors 131-134 with respect to the antenna element 510M are the same as the positions of the feeding elements 121-124 and the reflectors 131-134 with respect to the antenna element 510 illustrated in FIGS. 23 and 24. That is, the positions in the Y-axis direction of the feeding elements 121-124 and the line 512M of the antenna element 510M are aligned.

The aforementioned antenna element 510M and the antenna array 120 are separate radiation elements which are not connected to each other in the same way the antenna element 510 and the antenna array 120 illustrated in FIGS. 23 and 24.

As a result, it is possible to separately adjust the radiation characteristics of the antenna element 510 and the radiation characteristics of the antenna element 120.

Therefore, the antenna device 500M and the smartphone terminal device 10 (wireless communication device) may be provided in which the radiation characteristics of the antenna element for low frequencies and the radiation characteristics of the antenna element for high frequencies may be adjusted separately.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. An antenna device comprising:

a ground plane having an edge side;

a monopole antenna element that communicates in a first frequency, and that has a first feeding point, a first line that extends from the first feeding point in a direction away from the edge side of the ground plane, and a second line that is coupled to the first line and extends in a first direction which is a direction along the edge side; and a substrate includes a plurality of reflectors extending in the first direction and a plurality of dipole feeding elements extending in the first direction and disposed at a position which is closer to the monopole antenna element than the ground plane in a second direction which is perpendicular to the first direction, wherein the plurality of dipole feeding elements that communicate at a second frequency higher than the first frequency, and are disposed, with respect to the ground plane, in positions that match the positions of the second line with respect to the ground plane; and wherein the plurality of reflectors that reflect electromagnetic waves radiated by the plurality of dipole feeding elements, and are disposed respectively in correspondence to the plurality of dipole feeding elements between the ground plane and the plurality of dipole feeding elements.

2. The antenna device according to claim 1, wherein: the dipole feeding elements are a folded dipole antenna.

3. The antenna device according to claim 2, further comprising:

two parallel transmission lines which are disposed so as to overlap the ground plane as seen in a plan view while being insulated from the ground plane, and are coupled to the two feeding points of the folded dipole antenna.

4. The antenna device according to claim 1, wherein: the antenna element has a slit or a notch formed in the second line, and the plurality of dipole feeding elements are disposed in the slit or the notch.

5. The antenna device according to claim 1, further comprising:

a second substrate having a second plurality of dipole feeding elements and a second plurality of reflectors disposed thereon, and the plurality of dipole feeding elements and the plurality of reflectors are disposed on the substrates.

6. The antenna device according to claim 1, wherein:

a distance between the plurality of reflectors and the edge side of the ground plane is at least ¼ of an electrical length of a wavelength at the second frequency.

7. The antenna device according to claim 1, further comprising:

a plurality of wave directors that direct the electromagnetic waves radiated by the plurality of dipole feeding elements, and are respectively disposed on a side of the substrate opposite to the ground plane with respect to the plurality of dipole feeding elements.

8. The antenna device according to claim 1, wherein:

a distance between the second line and the edge side of the ground plane is no more than 1/40 of an electrical length of a wavelength at the first frequency.

9. The antenna device according to claim 1, wherein:

the second frequency is at least 20 times the first frequency.

10. An antenna device comprising:

a ground plane having an edge side;

a monopole antenna element that communicates in a first frequency, and that has a first feeding point, a first line that extends from the first feeding point in a direction away from the edge side of the ground plane, and a second line that is coupled to the first line and extends in a first direction which is a direction along the edge side; and a substrate includes a plurality of reflectors extending in the first direction and a plurality of dipole feeding elements extending in the first direction and disposed at a position which is closer to the monopole antenna element than the ground plane in a second direction which is perpendicular to the first direction, wherein the plurality of dipole feeding elements that communicate at a second frequency higher than the first frequency, and are disposed, with respect to the ground plane, in positions that match the positions of the second line with respect to the ground plane; and wherein a plurality of wave directors that direct electromagnetic waves radiated by the plurality of dipole feeding elements, and are respectively disposed on a side of the substrate opposite to the ground plane with respect to the plurality of dipole feeding elements.

11. A wireless communication device, comprising:

an antenna device and a feeder circuit for feeding power to the antenna device, wherein the antenna device includes:

a ground plane having an edge side;

a monopole antenna element that communicates in a first frequency, and that has a first feeding point, a first line that extends from the first feeding point in a direction away from the edge side of the ground plane, and a second line that is coupled to the first line and extends in a first direction which is a direction along the edge side; and a substrate includes a plurality of reflectors extending in the first direction and a plurality of dipole feeding elements extending in the first direction and disposed at a position which is closer to the monopole antenna element than the ground plane in a second direction which is perpendicular to the first direction, wherein the plurality of dipole feeding elements that communicate at a second frequency higher than the first frequency, and are disposed, with respect to the ground plane, in positions that match the positions of the second line with respect to the ground plane; and wherein the plurality of reflectors that reflect electromagnetic waves radiated by the plurality of dipole feeding elements, and are disposed respectively in correspondence to the plurality of dipole feeding elements between the ground plane and the plurality of dipole feeding elements.

* * * * *